US005300408A

United States Patent [19]

Okada et al.

[11] Patent Number: 5,300,408

[45] Date of Patent: Apr. 5, 1994

[54] METHOD OF BLEACHING OR BLEACH-FIXING A COLOR SILVER HALIDE PHOTOGRAPHIC MATERIAL

[75] Inventors: Hisashi Okada; Tadashi Inaba, both of Kanagawa, Japan

[73] Assignee: Fuji Photo Film Co., Ltd., Kanagawa, Japan

[21] Appl. No.: 990,251

[22] Filed: Dec. 14, 1992

[30] Foreign Application Priority Data

Dec. 12, 1991 [JP] Japan ..... 3-350665

[51] Int. Cl.[5] ..... G03C 7/00; G03C 5/44; G03C 5/38; G03C 5/42

[52] U.S. Cl. ..... 430/393; 430/430; 430/455; 430/460; 430/461

[58] Field of Search ..... 430/393, 428, 429, 430, 430/455, 460, 461

[56] References Cited

U.S. PATENT DOCUMENTS

| | | | |
|---|---|---|---|
| 4,563,405 | 1/1986 | Ishikawa et al. | 430/393 |
| 4,804,618 | 2/1989 | Ueda et al. | 430/393 |
| 4,894,320 | 1/1990 | Ueda et al. | 430/430 |
| 5,063,140 | 11/1991 | Kuse et al. | 430/393 |

*Primary Examiner*—Charles L. Bowers, Jr.
*Assistant Examiner*—J. Pasterczyk
*Attorney, Agent, or Firm*—Sughrue, Mion, Zinn, Macpeak & Seas

[57] ABSTRACT

A method for processing a silver halide color photographic material, which comprises processing an imagewise exposed silver halide color photographic material with a processing solution containing at least one chelate compound of a metal salt selected from the group consisting of salts of Fe(III), Mn(III), Co(III), Rh(II), Rh(III), Au(II), Au(III) and Ce(IV) with an organic acid represented by following general formula (I):

(I)

wherein Z represents a nonmetallic atom group required to form a heterocyclic group; R represents a substituent; n represents 0 or an integer of from 1 to 10; $Q_1$, $Q_2$ and $Q_3$ each represents a hydrogen atom, an aliphatic hydrocarbon group substituted by a carboxyl group, an aromatic hydrocarbon group substituted by a carboxyl group or a heterocyclic group substituted by a carboxyl group; and W represents a divalent linkage group containing at least one of an alkylene group or an arylene group.

17 Claims, No Drawings

METHOD OF BLEACHING OR BLEACH-FIXING A COLOR SILVER HALIDE PHOTOGRAPHIC MATERIAL

FIELD OF THE INVENTION

The present invention relates to a photographic processing composition for silver halide color photographic materials comprising a novel bleaching agent to be used in the bleaching step after color development and a process for the processing of a silver halide color photographic material using the photographic processing composition.

BACKGROUND OF THE INVENTION

Generally, a silver halide color photographic material (hereinafter, referred to as "color photographic material") is, after imagewise-exposure, processed by the processing steps of color development, desilvering, washing, stabilization, etc. Also, a silver halide color reversal photographic material is, after imagewise exposure, processed by the processing steps of black and white development, reversal processing, color development, desilvering, washing, stabilization, etc.

In the color development step for photographic processing, exposed silver halide grains are converted into silver by being reduced with a color developing agent and at the same time, the oxidation product of the color developing agent formed reacts with couplers to form dye images.

Then, in the subsequent desilvering step, developed silver formed by the development step is oxidized into a silver salt by a bleaching agent having an oxidative action (bleach), and further the silver salt is removed from the light-sensitive layer together with remaining silver halide by a fixing agent forming a soluble silver (fix). Bleaching and fixing may be carried out independently as a bleach step and a fix step or may be carried out simultaneously as a bleach-fix (blix) step. Details of the compositions and the processing steps are described in T. H. James, *The Theory of Photographic Process*, 4th edition, (1977), *Research Disclosure*, No. 17643, pages 28 to 29, ibid., 18716, page 651, left column to right column, ibid., No. 307105, pages 880 to 881.

In addition to the foregoing fundamental processing steps, various auxiliary steps are added for the purposes of keeping the photographic and physical qualities of dye images and keeping the stability of photographic processing. For example, there are a wash step, a stabilization step, a hardening step, a stop step, etc.

With the increase of the use of mini labs for processing of color photographic materials, a quick processing service for customers has been increased.

However, ethylenediaminetetraacetic acid ferric complex salt, which is conventionally used as a bleaching agent for a bleach step and/or a blix step in processing of color photographic materials, has a fundamental fault in that the oxidative power is weak. In spite of that the improvement such as the use of a bleach accelerator (e.g., the addition of the mercapto compound described in U.S. Pat. No. 1,138,842), etc., is added. However, quick bleaching has not yet been attained.

As a bleaching agent capable of attaining quick bleaching, potassium ferricyanide, iron chloride, bromates, etc., are known. However, potassium ferricyanide can not be widely used because of environmental concerns, iron chloride can not be widely used because of its inconvenience in handling, such as the corrosion of metals, etc., and bromates can not be widely used because of the problem of instability of the processing solution.

Accordingly, a bleaching agent capable of attaining quick bleaching having a good handling property without causing the problem at discharging the waste solution has been desired. Recently, as a bleaching agent meeting such requirements, 1,3-diaminopropanetetraacetic acid ferric complex salt has been disclosed as a bleaching agent.

However, the foregoing bleaching agent has a problem in performance, such as bleach fog forming with bleaching. As a method of reducing the formation of the bleach fog, it is disclosed to add a buffer to the bleach solution as described, e.g., in JP-A-1-213657 (the term "JP-A" as used herein means an "unexamined published Japanese patent application"). However, the improvement level is not sufficiently satisfactory. In particular, since a developer having a high activity is used in quick processing wherein the color development is carried out within 3 minutes, large bleach fog occurs even in the case of using such a buffer.

Furthermore, when the processing solution having a bleaching power containing the 1,3-diaminopropanetetraacetic acid ferric complex salt is used, there occurs a problem that during storing the photographic images after processing, the formation of stain is increased.

Moreover, when continuous processing is carried out using a processing solution having a bleaching power containing the 1,3-diaminopropanetetraacetic acid ferric complex salt, the desilvering property is greatly lowered as compared with the beginning of continuous processing. Also, precipitates form in the processing solution.

The inventors found a novel processing composition having a bleaching power, as described in JP-A-3-216650, as a means for solving these problems. However, it was found that the bleaching agent described in the above-cited patent causes yellow images to be discolored after processing. It has thus been desired to provide an alternative novel processing composition having a bleaching power and a processing method using such a processing composition.

SUMMARY OF THE INVENTION

The first object of the present invention is to provide a photographic processing composition having a bleaching power excellent in desilvering, and a processing method using the composition.

The second object of the present invention is to provide a photographic processing composition having a bleaching power and giving less bleaching fog, and a processing method using the composition.

The third object of the present invention is to provide a photographic processing composition having a bleaching power and causing less stains on photographic light-sensitive materials processed over the passage of time, and a processing method using the composition.

The fourth object of the present invention is to provide a photographic processing composition capable of stabilizing the above-described performances even in continuous processing, and a method using the composition.

It is a fifth object of the present invention to provide a processing composition having a bleaching power and which does not cause processed yellow images to be discolored by light, and to provide a processing method using such a processing composition.

These objects of the present invention are accomplished by use of the present processing composition for a silver halide color photographic material, comprising at least one chelate compound of a metal salt selected from the group of salts of Fe(III), Mn(III), Co(III), Rh(II), Rh(III), Au(II), Au(III) and Ce(IV) with an organic acid or a salt thereof, wherein the organic acid is represented by the following general formula (I):

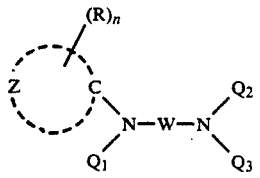

(I)

wherein Z represents a nonmetallic atom group required to form a heterocyclic group; R represents a substituent; n represents 0 or an integer of from 1 to 10; $Q_1$, $Q_2$ and $Q_3$ each represents a hydrogen atom, an aliphatic hydrocarbon group, an aromatic hydrocarbon group or a heterocyclic group; and W represents a divalent linkage group containing at least one of an alkylene group, and an arylene group, with the proviso that at least one of $Q_1$, $Q_2$ and $Q_3$ represents an aliphatic hydrocarbon group, an aromatic hydrocarbon group or a heterocyclic group each substituted by at least one of a hydroxyl group, a carboxyl group, a sulfo group, a phosphono group, an aliphatic or aromatic sulfonamido group, a sulfamoyl group, an aliphatic or aromatic carbonamido group, a carbamoyl group and a hydroxamic acid group.

These objects of the present invention are also accomplished by a processing method using such a processing composition.

DETAILED DESCRIPTION OF THE INVENTION

The present invention is now described in detail.

In the present invention a group having an acyl moiety represents a group having an aliphatic acyl moiety or an aromatic acyl moiety, and an aryl group represents a group having a phenyl group or a naphthyl group.

The compound represented by foregoing formula (I) is explained below in detail.

R represents a substituent. As the substituent shown by R, there are an alkyl group, an aralkyl group, an alkenyl group, an alkinyl group, an alkoxy group, an aryl group, an amino group, an acylamino group, an alkylsulfonylamino group, an arylsulfonylamino group, a ureido group, an alkoxycarbonylamino group, an aryloxycarbonylamino group, an aryloxy group, a sulfamoyl group, a carbamoyl group, an alkylthio group, an arylthio group, an alkylsulfonyl group, an arylsulfonyl group, an alkylsulfinyl group, an arylsulfinyl group, a hydroxy group, a halogen atom, a cyano group, a sulfo group, a carboxyl group, a phosphono group, an aryloxycarbonyl group, an acyl group, an alkoxycarbonyl group, an acyloxy group, an aliphatic or aromatic carbonamido group, an aliphatic or aromatic sulfonamido group, a nitro group, a hydroxamic acid group, etc. These groups (except a cyano group, a sulfo group, a carboxyl group, a phosphono group, a hydroxy group, a nitro group and a halogen atom) may be further substituted with at least one of these substituents. In the present invention in the ureido group at least one of two hydrogen atoms in the amino group may be substituted. $M^3$ and $M^4$ each has the same meanings as M in formula (I).

In more detail, as the substituent shown by R, there are an alkyl group (e.g., methyl and ethyl), an aralkyl group (e.g., phenylmethyl), an alkenyl group (e.g., allyl), an alkinyl group (e.g., ethinyl group), an alkoxy group (e.g., methoxy and ethoxy), an aryl group (e.g., phenyl and p-methylphenyl), an amino group (e.g., amino, and dimethylamino), an acylamino group (e.g., acetylamino and benzamido), an alkyl- and arylsulfonylamino group (e.g., methanesulfonylamino), a ureido group (e.g., ureido and methylureido), an alkyl- and aryl-oxycarbonylamino group (e.g., methoxycarbonylamino), an aryloxy group (e.g., phenyloxy), a sulfamoyl group (e.g., methylsulfamoyl), a carbamoyl group (e.g., carbamoyl and methylcarbamoyl), an alkylthio group (e.g., methylthio), an arylthio group (e.g., phenylthio), an alkyl- and aryl-sulfonyl group (e.g., methanesulfonyl), an alkyl- and aryl-sulfinyl group (e.g., methanesulfinyl), a hydroxy group, a halogen atom (e.g., chlorine, fluorine, and bromine), a cyano group, a sulfo group, a carboxyl group, a phosphono group, an aryloxycarbonyl group (e.g., phenyloxycarbonyl), an acyl group (e.g., acetyl and benzoyl), an alkoxycarbonyl group (e.g., methoxycarbonyl), an acyloxy group (e.g., acetoxy), an aliphatic or aromatic carbonamido group, an aliphatic or aromatic sulfonamido group, a nitro group, a hydroxamic acid group, etc. When the foregoing substituent has carbon atoms, the carbon atom number (in the present invention the carbon number of a group includes the number of the substituent(s) if the group has any) is preferably from 1 to 10, more preferably from 1 to 4.

The organic acid represented by formula (I) may be optionally in the form of a dissociated product or salt thereof (e.g., a salt of an akali metal atom such as Li, Na and K, ammonium such as ammonium and tetraethylammonium or pyridinium).

The substituent represented by R may be optionally in the form of a dissociated product or salt thereof.

Preferred among the substituents represented by R are a sulfo group, a carboxyl group, a phosphono group, a hydroxyl group, an alkoxy group, an amino group, a sulfamoyl group, a carbamoyl group, an alkylthio group, an aliphatic or aromatic carbonamide group, and an aliphatic or aromatic sulfonamide group. More preferred among these substituents are a sulfo group, a carboxyl group, a phosphono group, and hydroxyl group.

Further preferred among these substituents are a sulfo group, a carboxyl group, a phosphono group, particularly preferred a carboxyl group.

If n is plural, the plurality of R groups may be the same or different.

The alkylene group represented by W includes a straight chain, branched or cyclic alkylene group.

The aliphatic hydrocarbon group represented by $Q_1$, $Q_2$ or $Q_3$ is a straight-chain, branched or cyclic alkyl group, alkenyl group or alkynyl group, preferably having 1 to 10 carbon atoms. Preferred among these aliphatic hydrocarbon groups is an alkyl group, more preferably a $C_{1-4}$ (1 to 4 carbon atoms) alkyl group, particularly preferred a methyl group or ethyl group.

The aromatic hydrocarbon group represented by $Q_1$, $Q_2$ or $Q_3$ is a monocyclic or bicyclic aryl group such as a phenyl group and naphthyl group, preferably a phenyl group.

The heterocyclic group formed by Z and the heterocyclic groups represented by $Q_1$, $Q_2$ and $Q_3$ each is a 3- to 10-membered saturated or unsaturated heterocyclic group containing at least one of a nitrogen, an oxygen and a sulfur atoms. Such a heterocyclic group may be monocyclic or may form a condensed ring with other aromatic or heterocyclic groups. Such a heterocyclic group is preferably a 5- and 6-membered unsaturated heterocyclic group. Examples of such a heterocyclic group include a pyridine, pyrazine, pyrimidine, pyridazine, triazine, tetrazine, thiophene, furan, pyran, pyrrole, imidazole, pyrazole, thiazole, isothiazole, oxazole, isooxazole, oxadiazole, thiadiazole, thianthrene, isobenzofuran, chromene, xanthene, phenoxthine, indolizine, isoindole, indole, triazole, triazolium, tetrazole, quinolizine, isoquinoline, quinoline, phthalazine, naphthyridine, quinoxaline, quinazoline, cinnoline, carbazole, carboline, phenanthridine, acridine, pteridine, phenanthroline, phenazine, phenothiazine, phenoxazine, chroman, pyrroline, pyrazoline, indoline, and isoindoline rings. Preferred examples of such a heterocyclic group include monocyclic heterocyclic groups such as pyridine, pyrazine, pyrimidine, pyridazine, thiophene, furan, pyrrole, imidazole, triazole, tetrazole, pyrazole, thiazole, isothiazole, oxazole, isooxazole, thiadiazole, and oxadiazole rings. More preferably, such a heterocyclic group is a nitrogen-containing monocyclic 5- or 6-membered unsaturated heterocyclic group, particularly pyridine, pyrimidine, pyridazine, pyrrole, imidazole, triazole, tetrazole, and pyrazole rings.

These rings may be condensed with an aromatic ring or a 3- to 10-membered heterocyclic ring such as those disclosed as the examples of $Q_1$, $Q_2$ and $Q_3$.

The aliphatic hydrocarbon group, aromatic hydrocarbon group and heterocyclic group represented by $Q_1$, $Q_2$ or $Q_3$ may contain substituents. Examples of such substituents include substituents represented by R. At least one of $Q_1$, $Q_2$ and $Q_3$ is an aliphatic hydrocarbon group, aromatic hydrocarbon group or heterocyclic group substituted by hydroxyl group, a sulfo group, a carboxyl group, a phosphono group, an aliphatic or aromatic sulfonamido group, sulfamoyl group, an aliphatic or aromatic carbonamideo group, carbamoyl group or hydroxamic acid group (hereinafter referred to as "substituent group A"). The aliphatic hydrocarbon group, aromatic hydrocarbon group or heterocyclic group represented by $Q_1$, $Q_2$ or $Q_3$ substituted by these groups may contain substituents besides the substituent group A. As such substituents there can be used those represented by R set forth above.

Preferred examples of the substituent group A for $Q_1$, $Q_2$ and $Q_3$ include hydroxyl group, a sulfo group, a carboxyl group, a phosphono group, more preferably a carboxyl group.

$Q_1$, $Q_2$ and $Q_3$ each is preferably a hydrogen atom, an aliphatic hydrocarbon group or a heterocyclic group.

The divalent connecting group represented by W is preferably represented by the following general formula (W):

$$-(W^1-D)_m-W^2- \qquad (W)$$

wherein $W^1$ and $W^2$ may be the same or different and each represents a $C_{1-10}$ straight-chain, branched or cyclic alkylene group, a $C_{6-10}$ arylene group, or a $C_{7-10}$ aralkylene group; and D represents —O—, —S—, —N(Pw)— or a divalent nitrogen-containing heterocyclic group in which Pw represents a hydrogen atom or a $C_{1-8}$ alkyl group or $C_{6-10}$ aryl group which may be substituted by $-COOM_1$, $-PO_3M_2M_3$, —OH or $-SO_3M_4$ (in which $M_1$, $M_2$, $M_3$ and $M_4$ each represents a hydrogen atom or a cation). Examples of the cation represented by $M_1$, $M_2$, $M_3$ or $M_4$ include an alkaline metal atom such as lithium, sodium and potassium, and an ammonium such as ammonium and tetraethyl ammonium, and pyridinium. The linking group represented by W may contain at least one substituent. Examples of such substituents include those represented by R disclosed above.

The cycloalkylene group, arylene group and aralkylene group represented by $W_1$ or $W_2$ each may be condensed with a 5- or 6-membered ring, for example, 5- or 6-membered saturated or unsuturated hydrocarbon ring.

The divalent nitrogen-containing heterocyclic group may further contain at least one of O, S and N atoms in addition to the nitrogen atom.

A preferred example of the divalent nitrogen-containing heterocyclic group represented by D is a 5- or 6-membered heterocyclic group containing nitrogen atom as a hetero atom (such as imidazolyl group and pyrydyl group), more preferably heterocyclic group connected to $W^1$ and $W^2$ through adjacent carbon atoms, such as imidazolyl group.

A preferred example of $W^1$ and $W^2$ is a $C_{2-4}$ alkylene group.

The suffix m represents an integer of from 0 to 3. When m is 2 or 3, the plurality of ($W^1$—D) moieties may be the same or different. The suffix m is preferably 0 to 2, more preferably 0 or 1, particularly preferably 0.

Specific examples of the divalent connecting group W include the following groups (in the groups one of bondings may be connected to either nitrogen atom in formula (I) and the other bonding is connected to the other nitrogen atom):

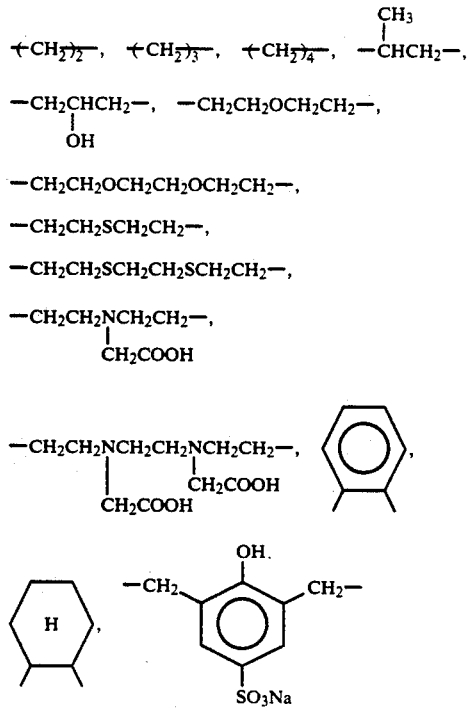

-continued

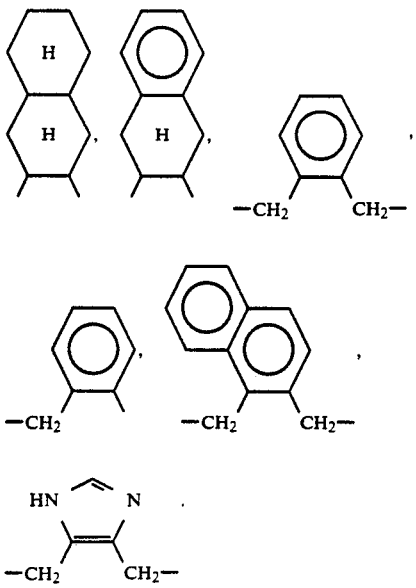

The general formula (I) is preferably represented by the following general formula (II), (III), (IV), (V) or (VI):

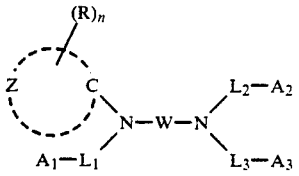

(II)

wherein Z, R, n, and W are as defined in general formula (I); $L_1$, $L_2$ and $L_3$ each represents an alkylene group or an arylene group; and $A_1$, $A_2$ and $A_3$ each represents a sulfo group, a carboxyl group, a phosphono group, a hydroxyl group, an aliphatic or aromatic sulfonamido group sulfamoyl group, an aliphatic or aromatic carbonamido group, carbamoyl group or hydroxamic acid group.

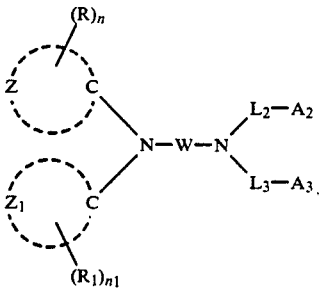

(III)

wherein Z, R, n, and W are as defined in general formula (I); $Z_1$, $R_1$, and $n_1$ have the same meaning as Z, R, and n in general formula (I), respectively; $L_2$ and $L_3$ are as defined in general formula (II); and $A_2$ and $A_3$ are as defined in general formula (II).

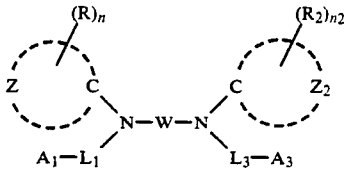

(IV)

wherein Z, R, n, and W are as defined in general formula (I); $Z_2$, $R_2$, and $n_2$ have the same meaning as Z, R, and n in general formula (I), respectively; $L_1$ and $L_3$ are as defined in general formula (II); and $A_1$ and $A_3$ are as defined in general formula (II).

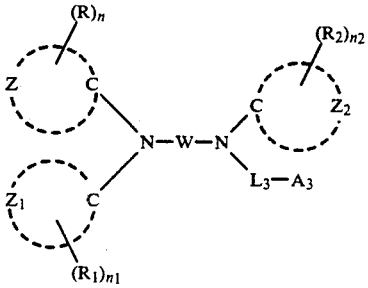

(V)

wherein Z, R, n, and W are as defined in general formula (I); $Z_1$ and $Z_2$ have the same meaning as Z in general formula (I); $R_1$ and $R_2$ have the same meaning as R in general formula (I); $n_1$ and $n_2$ have the same meaning as n in general formula (I); $L_3$ is as defined in general formula (II); and $A_3$ is as defined in general formula (II).

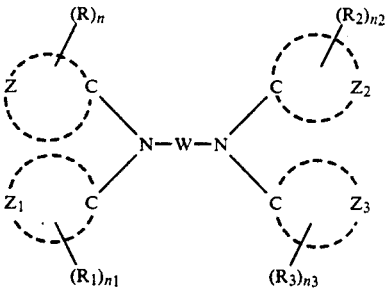

(VI)

wherein Z, R, n, and W are as defined in general formula (I); $Z_1$, $Z_2$, and $Z_3$ have the same meaning as Z in general formula (I); $R_1$, $R_2$ and $R_3$ have the same meaning as R in general formula (I); and $n_1$, $n_2$ and $n_3$ have the same meaning as n in general formula (I).

In the general formulae (I) to (VI), the substituents represented by R, $R_1$, $R_2$ and $R_3$ each is preferably substituted at the carbon atom adjacent to the carbon atom to which the nitrogen atom in the amino group in the formula is connected. Particularly preferred rings which connect to the nitrogen atom in formula (I) are as follows:

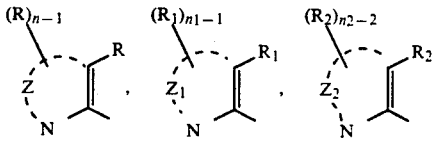

and

-continued

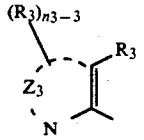

wherein Z, $Z_1$, $Z_2$ and $Z_3$ each represents a nonmetallic atom group required to form a nitrogen-containing monocyclic 5- or 6-membered unsaturated heterocyclic group, R, $R_1$, $R_2$ and $R_3$ each represents a carboxy group, a phosphono group, or a sulfo group, and n, $n_1$, $n_2$ and $n_3$ each represents an integer of from 1 to 3.

The alkylene group represented by $L_1$, $L_2$ or $L_3$ in the general formulae (II), (III), (IV) and (V) may be a straight-chain or branched alkylene group, preferably containing 1 to 6 carbon atoms. $L_1$, $L_2$ and $L_3$ may be the same or different. In addition, $L_1$, $L_2$ and $L_3$ may contain substituents. Examples of such substituents include those described with reference to $Q_1$. $L_1$, $L_2$ and $L_3$ each is preferably a methylene group or ethylene group.

The arylene group represented by $L_1$, $L_2$ or $L_3$ is preferably a $C_{6-10}$ arylene group such as a phenylene group and naphthylene group, more preferably a phenylene group.

Among these groups the most preferred $L_1$, $L_2$ and $L_3$ each is an alkylene group, and particularly preferably is a methylene group or an ethylene group.

Preferred examples of $A_1$, $A_2$ and $A_3$ in the general formulas (II), (III), (IV), (V) and (VI) include a sulfo group, a carboxyl group, a phosphono group, and a hydroxyl group. Preferred among these groups are a sulfo group, a carboxyl group, and a phosphono group. Particularly preferred among these groups is a carboxyl group.

Among the general formulas (II), (III), (IV), (V) and (VI), the general formulas (II), (III) and (IV) are preferred. General formula (II) is particularly preferred.

As the metallic salt constituting the metallic chelate compound of the present invention there can be a metallic salt selected from salts of Fe(III), Mn(III), Co(III), Rh(II), Rh(III), Au(II), Au(III) and Ce(IV). Preferred among these metallic salts are salts of Fe(III), Mn(III) and Ce(IV), and particularly preferred is a metallic salt of Fe(III).

Examples of metal salts include sulfates chlorides, nitrates, ammonium sulfates, and phosphates.

The Fe(III) chelate compound is preferable because it is easily made to exhibit the function to obtain the effects of the present invention, there is less problem with respect to coloring, it is easily available and cheap, and it has excellent aging stability.

Specific examples of metallic chelate compounds of the present invention are given below by Compounds K-1 to K-8, but the present invention should not be construed as being limited thereto.

K-1

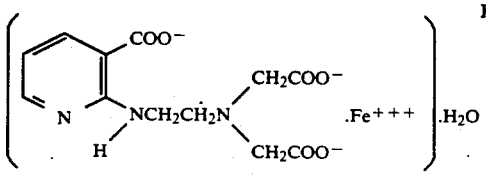

-continued

K-2

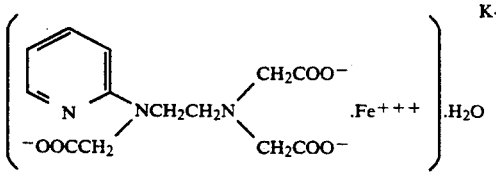

K-3

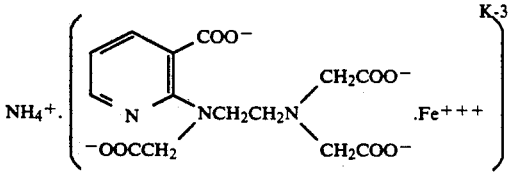

K-4

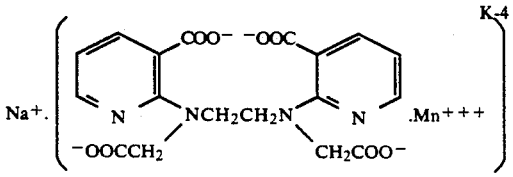

K-5

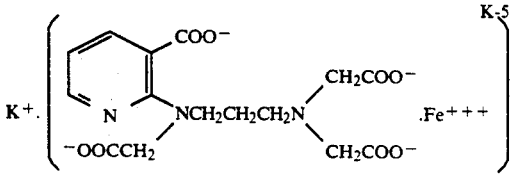

K-6

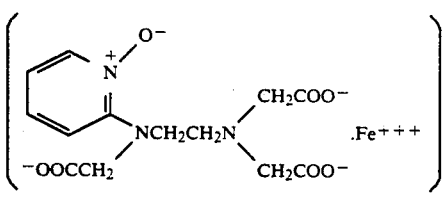

K-7

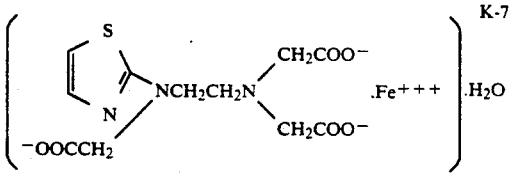

K-8

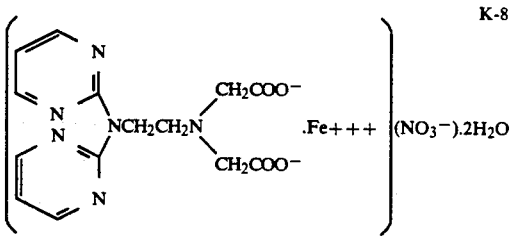

Next, the process for the synthesis of the metallic chelate compounds of the present invention will be described hereinafter. The starting material and compounds used in the synthesis are commercially available.

In the process for the synthesis of metallic chelate compounds of the present invention, an organic acid represented by the general formula (I) is synthesized as follows:

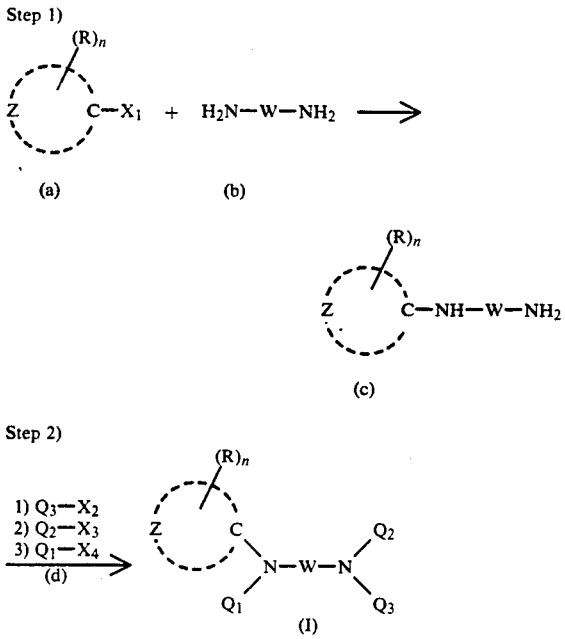

wherein $X_1$, $X_2$, $X_3$ and $X_4$ each represents a halogen atom (such as F, Cl, Br and I); Z, R, n, W, $Q_1$, $Q_2$ and $Q_3$ are as defined in the general formula (I), respectively.

That is, the compound of general formula (I) can be synthesized by the above reaction. The halogen atom represented by $X_1$ in the halogen-substituted heterocyclic group derivative (a) of Step 1) is substituted by a diamine derivative (b) to obtain a compound (c) which is then reacted with a halogen-substituted compound (d) such as 1), 2) or 3) in Step 2) of the above reaction. With respect to the reactions J. Chem, Soc., 80, 800 (1985) may be referred.

The reaction of the halogen-substituted heterocyclic group derivative with the diamine derivative is preferably conducted in the presence of an alkali compound and a catalyst. As the alkali there can be used potassium carbonate, sodium carbonate, etc. As the catalyst there can be used copper powder, CuCl, CuBr, CuO, etc. This reaction may or may not be conducted in a solvent. Such a solvent, if used, is not specifically limited so far as it doesn't take part in the reaction. Examples of such a solvent include an alcohol such as methanol, ethanol, isopropanol, butanol and pentanol, and further include dioxane, and dimethylformamide.

The reaction with the halogen-substituted compound is preferably conducted in a solvent. Such a solvent, if used, is not specifically limited so far as it doesn't take part in the reaction. Examples of such a solvent include water, an alcohol such as methanol, ethanol and isopropanol, and further include dioxane. This reaction is preferably conducted in the presence of a base. Examples of such a base include sodium hydroxide, potassium hydroxide, a tertiary amine (e.g., triethylamine), and pyridine.

The reaction product can be then reacted with a metallic salt (e.g., ferric sulfate, ferric chloride, ferric nitrate, ferric ammonium sulfate, ferric phosphate) to obtain a desired metallic chelate compound.

SYNTHESIS EXAMPLE 1

Synthesis of Compound K-3

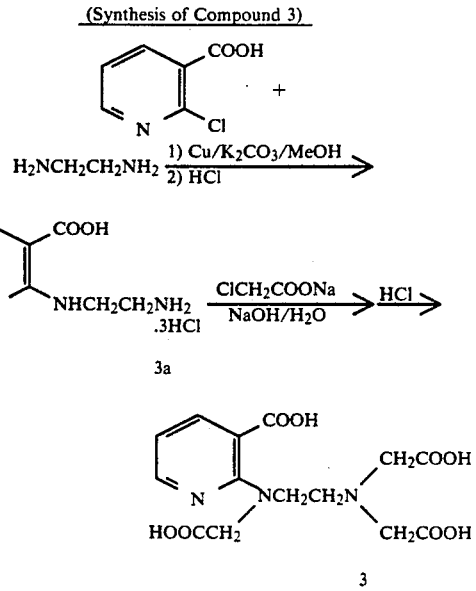

Synthesis of Compound 3a

A 25.0 g (0.159 mole) amount of 2-chloro-3-carboxypyridine, 95.4 g (1.59 mole) of ethylenediamine, 40.0 g (0.289 mole) of potassium carbonate, and 0.3 g of copper powder were suspended in 100 ml of methanol. The suspension was heated under reflux for 2 hours. Undissolved matters were then removed by filtration. The filtrate was then concentrated. The concentrated filtrate was adjusted to a pH value of about 1.0 with concentrated hydrochloric acid. The solid material thus precipitated was filtered off, washed with cold water, and then dried to obtain 33.2 g (0.114 mole) of a light yellow solid Compound 3a. (Yield: 72%)

Synthesis of Compound 3

A 29.1 g (0.100 mole) amount of Compound 3a thus obtained and 38.4 g (0.330 mole) of sodium chloroacetate were dissolved in 70 ml of water. A 124 ml (0.620 mole) amount of a 5N aqueous solution of sodium hydroxide was gradually added to the solution with stirring at a temperature of 50° C. so that the pH value of the system was adjusted to 9 to 10. The mixture was stirred at a temperature of 50° C. for 4 hours. The reaction solution was filtered. The filtrate was concentrated to about 60 ml. A 43.7 g (0.430 mole) amount of concentrated hydrochloric acid was added to the concentrated filtrate. The reaction system was allowed to stand in a refrigerator thereby forming a solid material. The solid matter thus precipitated was filtered off, washed with cold water, and then dried under a reduced pressure to obtain 13.1 g (0.0369 mole) of white crystals of Compound 3. The yield was 37%.

| Elementary analysis for $C_{14}H_{17}N_3O_8$: | | | |
|---|---|---|---|
| | H | C | N |
| Calculated %: | 4.82 | 47.33 | 11.83 |
| Found %: | 4.93 | 47.16 | 11.69 |

A 40.4 g (0.100 mole) amount of ferric nitrate nonahydrate and 37.3 g (0.105 mole) of Compound 3 were dissolved in 200 ml of water. The suspension was then adjusted to a pH value of 5.0 with a 29% aqueous ammonia. The material was then filtered through a glass filter. The filtrate was concentrated under reduced pressure to about 50 ml in order to precipitate a salt. The salt thus precipitated was removed by filtration. The filtrate was again concentrated under reduced pressure to about 30 ml. The salt thus precipitated was removed by filtration. Ethanol was then added to the filtrate to precipitate a brown solid matter. The crude crystal thus obtained was recrystallized from a mixture of water and ethanol, and then dried at room temperature under reduced pressure to obtain 14.5 g (0.034 mole) of desired Compound K-3. The yield was 34%.

Other chelate compounds of the present invention can be similarly synthesized.

The metallic chelate compound of the present invention can be used by synthesizing it by separately adding an organic acid represented by general formula (I) and the above mentioned metallic salt (e.g., ferric sulfate, ferric chloride, ferric nitrate, ferric ammonium sulfate, ferric phosphate) to a processing solution so that they react with each other. In other words, it is sufficient that if the complex of a metallic salt having an organic acid represented by general formula (I) as a ligand is formed in a processing solution.

Specific examples of the organic acid represented by the general formula (I) will be given below, but the present invention should not be construed as being limited thereto.

1.

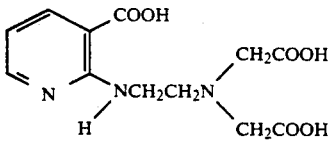

2.

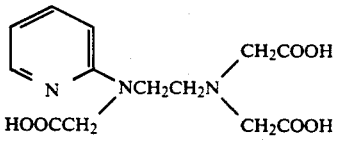

3.

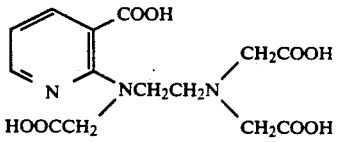

4.

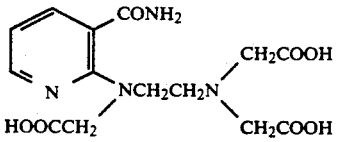

5.

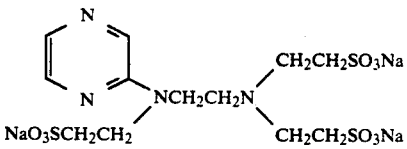

-continued

6.

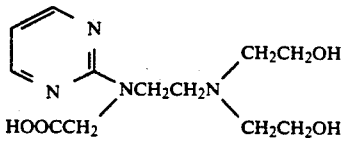

7.

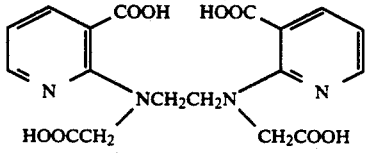

8.

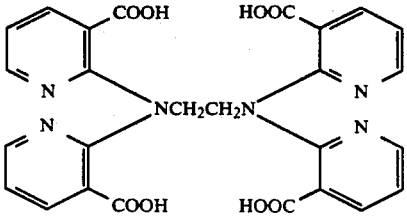

9.

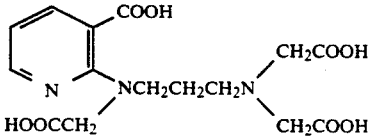

10.

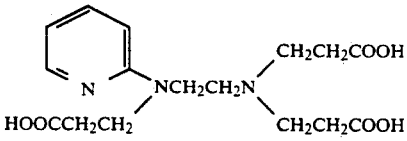

11.

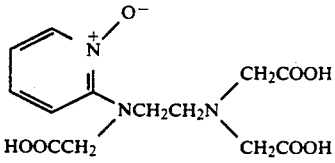

12.

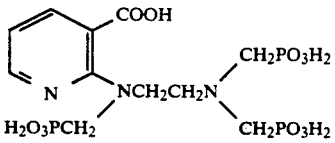

13.

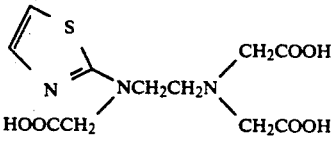

14.

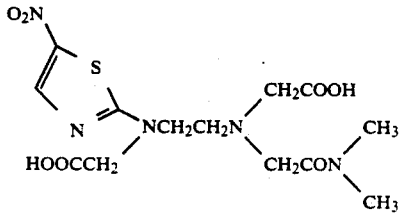

-continued
15.
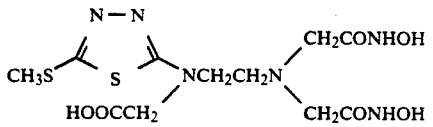
16.
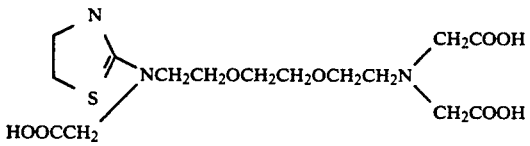
17.
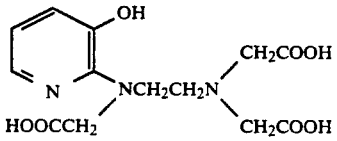
18.
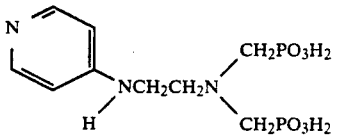
19.
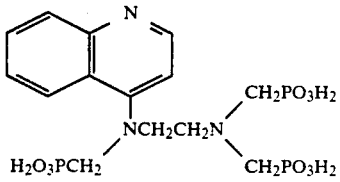
20.
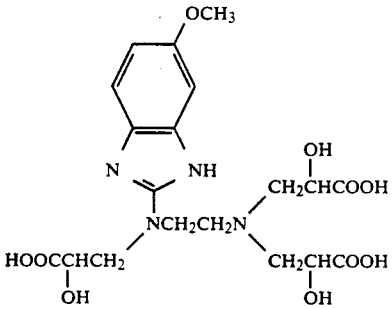
21.
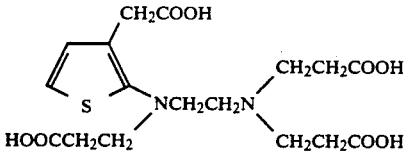
22.
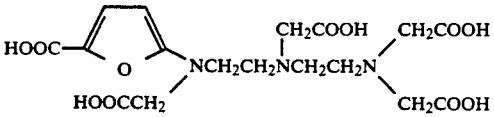
23.
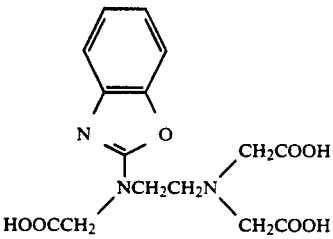
-continued
24.
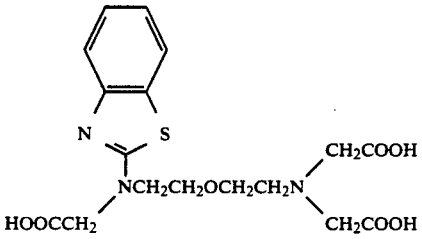
25.
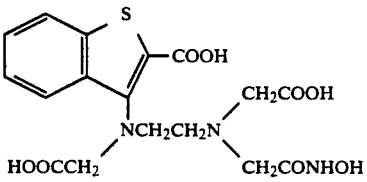
26.
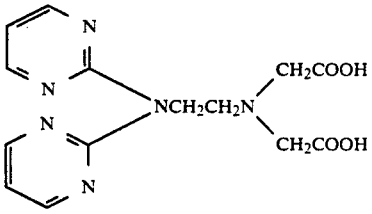
27.
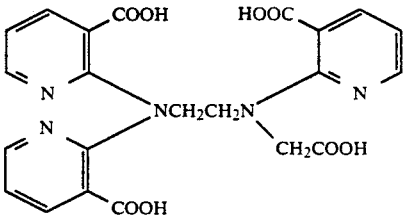
28.
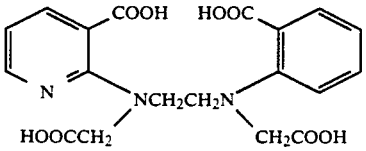
29.
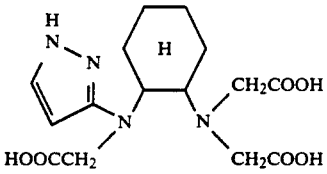
30.
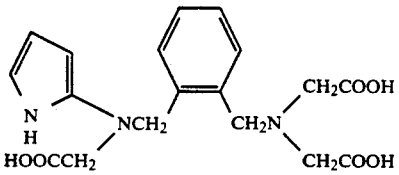
31.
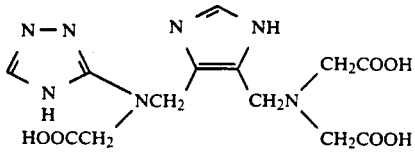

-continued

32.

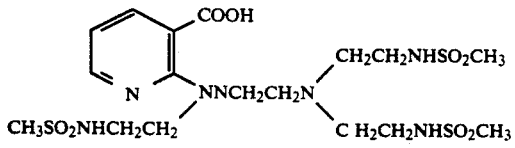

In accordance with an embodiment of the processing composition containing the metallic chelate compound of the present invention, a silver halide color photographic material which has been imagewise exposed to light and color-developed can then be processed with a processing composition containing at least the metallic chelate compound of the present invention to bleach developed silver at an extremely high rate without causing remarkable bleach fog that can be seen with conventional bleaching agents having rapid bleaching power. Further, the silver halide color photographic material thus processed can exhibit an excellent image preservation. The processing composition of the present invention is also advantageous in that it is easy to handle.

The metallic chelate compound of the present invention can be used by synthesizing it by reacting an organic acid represented by general formula (I) with the above mentioned metallic salt in a solution. In this case, the organic acid represented by general formula (I) is preferably used in a molar ratio of 1.0 or more to the metallic ion. The molar proportion is preferably higher if the stability of the metallic chelate compound is low. The molar proportion is normally in the range of 1.0 to 30.0.

The metal chelate compound for use in this invention may be incorporated in a fixing solution or an intermediate bath between a color development and a desilvering step in a small amount (preferably 1 m mol/l to 0.01 mol/l; in order to accelarate a rapid process) thereof, but by adding from 0.01 to 1 mol of the metal chelate compound per liter of a processing solution, the compound is effective as a bleaching agent for a bleaching solution or a blixing solution.

Next, a processing solution having a preferred bleaching ability (including a bleaching solution and a blix solution) is explained.

The metal chelate compound for use in this invention is effective as a bleaching agent for the processing solution having a bleaching ability when the solution contains the compound in an amount of from 0.01 to 1 mol per liter of the solution as described above, and the amount of the metal chelate compound is more preferably from 0.05 to 0.5 mol, and particularly preferably from 0.1 to 0.5 mol per liter of the processing solution.

When the metal chelate compound in this invention is used as a bleaching agent for the processing solution having a bleaching ability, the compound may be used together with another known bleaching agent in a range of giving the effect of the present invention. As such a known bleaching agent, there are the Fe(III), Co(III), or Mn(III) chelate bleaching agents of the compounds shown below and persulfates (e.g., peroxodisulfate), hydrogen peroxide, bromates, etc.

That is, as the compound for forming the foregoing chelate bleaching agent, there are ethylenediaminetetraacetic acid, diethylenetriaminepentaacetic acid, ethylenediamine-N-(β-hydroxyethyl)-N,N',N'-triacetic acid, 1,2-diaminopropanetetraacetic acid, 1,3-diaminopropanetetraacetic acid, nitrilotriacetic acid, cyclohexanediaminetetraacetic acid, iminodiacetic acid, dihydroxyethylglycine, ethyl ether diaminetetraacetic acid, glycol ether diaminetetraacetic acid, ethylenediaminetetrapropionic acid, phenylenediaminetetraacetic acid, 1,3-diaminopropanol-N,N,N',N'-tetramethylenephosphonic acid, ethylenediamine-N,N,N',N'-tetramethylenephosphonic acid, 1,3-propylenediamine-N,N,N',N'-tetramethylenephosphonic acid, and the sodium salts and ammonium salt thereof.

It is preferred that the processing solution containing the metal chelate compound for use in this invention as a bleaching agent and having a bleaching ability further contains a halide, such as a chloride, a bromide, an iodide, etc., as a rehalogenating agent for accelerating the oxidation of silver. Also, the processing solution may contain an organic ligand forming a sparingly soluble silver salt in place of the halide. The halide is added to the processing solution as an alkali metal salt, an ammonium salt, or a salt of guanidine, amine, etc. Practically, there are sodium bromide, ammonium bromide, potassium chloride, guanidine hydrochloride, etc., and ammonium bromide or sodium bromide is preferable. In the bleach solution, the amount of the rehalogenating agent is properly not more than 2 mols/liter, preferably from 0.01 to 2.0 mols/liter, and more preferably from 0.1 to 1.7 mols/liter.

The blix solution containing the metal chelate compound for use in this invention further contains a fixing agent (shown below) and, if necessary, can further contain the foregoing rehalogenating agent. In the case of using the rehalogenating agent in the blix solution, the amount thereof is from 0.001 to 2.0 mols/liter, and preferably from 0.001 to 1.0 mol/liter.

The bleach solution or the blix solution being used in the present invention may, if necessary, contain a bleach accelerator, a corrosion inhibitor inhibiting the corrosion of the processing bath, a buffer for keeping the necessary pH of the solution, an optical whitening agent, a defoaming agent, etc.

As the bleach accelerator which can be used in this invention, there are the compounds having a mercapto group or a disulfide group described in U.S. Pat. No. 3,893,858, West German Patent 1,290,812, U.S. Pat. No. 1,138,842, JP-A-53-95630, and *Research Disclosure*, No. 17129 (1978); the thiazolidine derivatives described in JP-A-50-140129; the thiourea derivative described in U.S. Pat. No. 3,706,561; the polyethylene oxides described in West German Patent 2,748,430; the polyamine compounds described in JP-B-45-8836; and the imidazole compounds described in JP-A-49-40493. Of these compounds, the mercapto compounds described in U.S. Pat. No. 1,138,842 are preferable.

Also, as the corrosion inhibitor, a nitrate is preferably used and ammonium nitrate, sodium nitrate, potassium nitrate, etc., is used. The addition amount thereof is from 0.01 to 2.0 mols/liter, and preferably from 0.05 to 0.5 mol/liter.

In the bleach solution or the blix solution for use in this invention, the ammonium ion concentration can be reduced to 0.3 mol/liter or lower. This embodiment is preferable from the view point of the environmental preservation and, if necessary, in the present invention the concentration can reduced to 0.1 mol/liter or lower.

The pH of the bleach solution or the blix solution in this invention is from 2.0 to 8.0, and preferably from 3.0 to 7.5. In a color photographic material for photographing, when the photographic material is bleached or blixed immediately after color development, it is better to use the processing solution at a pH of 7.0 or lower, and preferably 6.4 or lower. In particular, in the case of the bleach solution, the pH thereof is preferably from 3.0 to 5.0. If the pH is lower than 2.0, the metal chelate compound in this invention becomes unstable and hence the pH of the processing solution is preferably from 2.0 to 6.4. Also, in the case of color print materials, the pH of the processing solution is preferably in the range of from 3 to 7.

For the purpose, as the pH buffer, any buffers which are reluctant to be oxidized with the bleaching agent and show a buffer action in the foregoing pH range can be used. Examples thereof are organic acids, such as acetic acid, glycolic acid, lactic acid, propionic acid, butyric acid, malic acid, malonic acid, chloroacetic acid, levulinic acid, ureidopropionic acid, etc.; and organic bases, such as pyridine, dimethylpyrazole, 2-methyl-o-oxazoline, aminoacetonitrile, etc. These buffers may be used alone or in combination thereof. In the present invention, an organic acid having a pKa of from 2.0 to 5.5 is preferably used as the buffer and, in particular, the use of acetic acid and/or glycolic acid is preferred.

The amount of the buffer is properly 3.0 mols or less, and preferably from 0.5 to 2.0 mols per liter of the processing solution having a bleaching ability.

For controlling the pH of the processing solution having the bleaching ability in the foregoing range, an alkali agent (e.g., aqueous ammonia, potassium hydroxide, sodium hydroxide, imidazole, monoethanolamine, and diethanolamine) may be used together with the foregoing acid. In these materials, aqueous ammonia is preferable.

The bleaching step or the blixing step is carried out in the temperature range of from 30° C. to 60° C., and preferably from 35° C. to 50° C.

The processing time of the bleaching and/or the blixing step is in the range of from 10 seconds to 7 minutes, and preferably from 10 seconds to 2 minutes in a light-sensitive material for photographing. Also, the processing time thereof is from 5 seconds to 70 seconds, preferably from 5 seconds to 60 seconds, and more preferably from 10 seconds to 45 seconds in a photographic light-sensitive material for printing. In these preferred processing conditions, good results of quick processing and having no increase of stains are obtained.

For the blix solution or the fix solution, a known fixing agent may be used. As the fixing agent, there are thiosulfates, thiocyanates, thioethers, amines, mercaptos, thiones, thioureas, iodides, mesoions, etc. Practical examples thereof are ammonium thiosulfate, sodium thiosulfate, potassium thiosulfate, guanidine thiosulfate, potassium thiocyanate, dihydroxyethyl thioether, 3,6-dithia-1,8-octanediol, and imidazole. In these materials, thiosulfates, in particular, ammonium thiosulfate is preferred for carrying out quick fixing. Furthermore, by using two or more kinds of the fixing agents, more quick fixing can be carried out. For example, a combination of ammonium thiosulfate and foregoing ammonium thiocyanate, imidazole, thiourea, thioether, etc., can be preferably used, and in this case, as the secondary fixing agent, it is preferred to use the secondary fixing agent in the range of from 0.01 to 100 mol % to ammonium thiosulfate.

The amount of the fixing agent is from 0.1 to 3.0 mols, and preferably from 0.5 to 2.0 mols per liter of the blix solution or the fixing solution. The pH of the fixing solution depends upon the kind of the fixing agent but is generally from 3.0 to 9.0. In particular, in the case of using a thiosulfate, the pH of the fix solution is preferably from 6.5 to 8.0 for obtaining a stable fixing performance.

The blix solution or the fixing solution can contain a preservative for increasing the stability of the solution with the passage of time. In the case of a blix solution or a fixing solution containing a thiosulfate, sulfites and/or hydroxylamine, hydrazine, bisulfite addition products of an aldehyde (e.g., bisulfite addition products of acetaldehyde and, particularly preferably, the bisulfite addition products of aromatic aldehydes described in JP-A-1-298935), etc., are effective as the preservatives. Also, the sulfinic acid compounds described in JP-A-62-143048 are preferably used as the preservatives.

Also, for keeping the pH of the blix solution or the fixing solution at a constant value, it is preferable to add a buffer to the solution. Examples of the buffer are phosphates; imidazoles such as imidazole, 1-methylimidazole, 2-methyl-imisdazole, 1-ethyl-imidazole, etc., triethanolamine; N-allylmorpholine; and N-benzoylpiperazine.

Furthermore, in the fixing solution, the stability of the solution can be improved by adding thereto various chelating agents to mask iron ions carried in from a bleaching solution. Examples of preferred chelating agent are 1-hydroxyethylidene-1,1-diphosphonic acid, ethylenediamine-N,N,N',N'-tetramethylenephosphonic acid, nitrilotrimethylenephosphonic acid, ethylenediaminetetraacetic acid, diethylenetriaminepentaacetic acid, cyclohexanediaminetetraacetic acid, and 1,2-propanediaminetetraacetic acid.

The fixing step is carried out in the temperature range of from 35° C. to 50° C.

The processing time for the fixing step is from 15 seconds to 2 minutes, and preferably from 25 seconds to 1 minute and 40 seconds for a light-sensitive material for photographing and from 8 seconds to 80 seconds and preferably from 10 seconds to 45 seconds for a photographic light-sensitive material for print.

The desilvering step in this invention is carried by the combinations of a bleaching step, a fixing step, and a blixing step, and typical examples of these combinations are as follows.

(1) Bleaching-fixing
(2) Bleaching-blixing
(3) Bleaching-blixing-fixing
(4) Bleaching-washing-fixing
(5) Blixing
(6) Fixing-blixing In a light-sensitive material for photographing, the combination (1), (2), (3), or (4) is preferable, and the combination (1), (2) or (3) is more preferable. In a photographic light-sensitive material for print, the combination (5) is preferable.

The present invention can be applied to a desilvering processing through, for example, a stop bath, a wash bath, etc., after color development processing.

In the desilvering processing step in the present invention, such as bleaching, blixing, fixing, etc., it is preferable that the processing solution is stirred as strong as possible for more efficiently obtaining the effect of the present invention.

As a practical method of strengthening the stirring, there are a method of applying jet stream of the processing solution to the surface of the emulsion layer of a photographic light-sensitive material, described in JP-A-62-183460 and JP-A-62-183461, a method of increasing the stirring effect by using a rotation means, described in JP-A-62-183461, a method of improving the stirring effect by transferring a photographic light-sensitive material while contacting the surface of the emulsion layer thereof with a wiper blade disposed in the processing solution to form a disturbed stream on the surface of the emulsion layer of the light-sensitive material, and a method of increasing the circulating amount of the entire processing solution. The foregoing stirring increasing means is preferably used for a color developer, a wash solution, or a stabilization solution.

It is preferable that the processing process of the present invention is carried out using an automatic processor. The transporting method of photographic light-sensitive materials in such an automatic processor is described in JP-A-60-191257, JP-A-60-191258, and JP-A-60-191259. Also, for carrying out quick processing in an automatic processor, it is preferable to shorten the crossover between the processing baths. The automatic processor wherein the crossover time is 5 seconds or shorter is described in JP-A-1-319038.

In the case of carrying out continuous processing using an automatic processor according to the processing process of the present invention, it is preferred to supply each replenisher to each processing solution in accordance with the amount of photographic light-sensitive materials processed for compensating the loss of the components of each processing solution with the processing of the photographic light-sensitive materials, and also for preventing the accumulation of undesirable components dissolved out from the photographic light-sensitive materials processed in each processing solution. Also, two or more processing tanks may be employed for each processing step and in this case, it is preferred to employ a countercurrent system of supplying the replenisher from the post-bath tank to the preceding bath tank. In particular, in a washing step and a stabilization step, a cascade-type countercurrent system of from 2 to 4 stages is preferably used.

The amount of each replenisher is preferably low if the change of the composition in the processing solution does not cause troubles for the photographic performances and staining of the solution.

The amount of the replenisher for a bleaching solution is from 10 ml to 1,000 ml, and preferably from 50 ml to 550 ml per square meter of a photographic light-sensitive material being processed in the case of a color photographic material and is from 20 ml to 500 ml, and preferably from 50 ml to 300 ml per square meter of a photographic light-sensitive material in the case of a print material.

The amount of the replenisher for a blix solution is from 200 ml to 3,000 ml, and preferably from 250 ml to 1,300 ml per square meter of a photographic light-sensitive material in the case of a color photographic material and is from 20 ml to 300 ml, and preferably from 50 ml to 200 ml per square meter of a photographic light-sensitive material in the case of a print material.

The replenisher for a blix solution may be replenished as one solution or may be replenished separately as a bleaching composition and a fixing composition. Also, a mixture of the overflow solutions from bleaching baths and/or fixing baths may be used as a replenisher for a blix solution.

The amount of the replenisher for the fixing solution is from 300 ml to 3,000 ml, and preferably from 300 ml to 1,200 ml per square meter of a photographic light-sensitive material in the case of a color photographic material and is from 20 ml to 300 ml, and preferably from 50 ml to 200 ml per square meter of a photographic light-sensitive material in the case of a print material.

For further lowering the amount of the foregoing replenisher for environmental preservation, it is preferable to use a combination of various regeneration methods. The regeneration of each processing solution may be practiced while circulating the processing solution in an automatic processor or after once recovering the processing solution from the processing tank and applying thereto a proper regeneration treatment, the solution may be supplied again to the processing bath as the replenisher.

Since a metal chelate bleaching agent in a bleaching solution and/or a blix solution becomes in a reduced state with bleaching processing, it is preferred to employ a continuous regeneration method for the bleaching solution and/or the blix solution in corporation with processing. Practically, it is preferred to blow air into the bleaching solution and/or the blix solution by means of an air pump and reoxidizing (or so-called aerating) the metal chelate in a reduced state with oxygen. Furthermore, by adding an oxidizing agent, such as hydrogen peroxide, a persulfate, a bromate, etc., to the bleaching solution and/or the blix solution, the processing solution can be also regenerated.

The regeneration of a fixing solution and a blix solution is carried out by electrolytically reducing accumulated silver ions. Furthermore, it is preferred for keeping the fixing ability to remove accumulating halogen ions with an anion exchange resin.

Other processing solutions which can be used in the present invention are described in JP-A-3-216650 (line 4, lower left column, page 12—line 19, lower right column, page 15).

As photographic light-sensitive materials which can be processed by the processing composition of the present invention, there are ordinary multi layer silver halide color photographic materials (e.g., color negative photographic films, color reversal photographic films, color positive photographic films, cine color negative photographic films, color photographic papers, reversal color photographic papers, and direct positive color photographic papers), infrared photographic light-sensitive materials for laser scanner, diffusion transfer photographic light-sensitive materials (e.g., silver diffusion transfer photographic light-sensitive materials, and color diffusion transfer photographic light-sensitive materials), etc.

The photographic light-sensitive material being processed by the processing composition of the present invention can have various layer structures (e.g., silver halide emulsion layers each having a light-sensitive to red, green, or blue, a subbing layer, an antihalation layer, a filter layer, interlayers, and surface protective layer(s)) and layer dispositions on one surface or both the surfaces thereof according to the purpose of the photographic light-sensitive materials.

In the present invention, there are no particular restrictions on the supports of the photographic light-sensitive materials the coating methods, the kinds of silver halide being used for the silver halide emulsion layers, surface protective layers, etc. (e.g., silver iodobromide, silver iodochlorobromide, silver bromide, silver chlorobromide, and silver chloride); the grain forms of the silver halide grains (e.g., cubic, tabular, and spherical); the grain sizes thereof; the variation coefficients thereof; the crystal structures (e.g., core/shell structure, multiphase structure, and uniform phase structure); the production method thereof (e.g., a single jet method and a double jet method); binders (e.g., gelatin); hardening agents; antifoggants; metal doping agents; silver halide solvents; thickeners; emulsion precipitating agents; dimensional stabilizers; adhesion inhibitors; stabilizers; color mixing inhibitors; stain inhibitors; dye image stabilizers, chemical sensitizers; spectral sensitizers; sensitivity increasing agents; super sensitizers; nucleating agents; couplers (e.g., pivaloylacetanilide type or benzoylacetanilide type yellow couplers, 5-pyrazolone type or pyrazoloazole type magenta couplers, phenol type or naphthol type cyan couplers, DIR couplers, bleach accelerator releasing type couplers, competing couplers, and colored couplers); coupler dispersing methods (e.g., oil drop-in-water dispersion method using a high-boiling solvent); plasticizers; antistatic agents; lubricants; coating aids; surface active agents; brightening agents; formalin scavengers; light scattering agents; matting agents; light absorbents; ultraviolet absorbents; filter dyes, irradiation dyes; development improving agents; delustering agents; antiseptics (e.g., 2-phenoxyethanol); antifungus agents, etc., and those described in *Product Licensing*, Vol. 92, 107 to 110 (December, 1971), *Research Disclosure* (RD), No. 17643 (December, 1978), ibid., No. 18716 (November, 1979), ibid., No. 307105 (November, 1989), and JP-A-3-216650, page 15, the lower right column, line 20 to page 20, lime 6 can be used.

Next, the following examples are intended to illustrate the present invention practically but not to limit it in any way.

EXAMPLE 1

A multilayer color photographic material A having the layers of the following compositions on a cellulose triacetate film support having a subbing layer was prepared.

Composition of Layers

The principal materials used in the layers are classified as follows:

ExC: cyan coupler
ExM: magenta coupler
ExY: yellow coupler
ExS: sensitizing dye
UV: ultraviolet absorber
HBS: high boiling point solvent
H: gelatin hardener The coating amount was shown by a g/m$^2$ unit of silver for a silver halide in an emulsion and colloidal silver, by a g/m$^2$ unit for couplers, additives and gelatin, and by mol number per mol of silver halide in the same layer for a sensitizing dye.

| | |
|---|---|
| Layer 1: Antihalation layer | |
| Black Colloidal Silver | 0.20 as Ag |
| Gelatin | 2.20 |
| UV-1 | 0.11 |
| UV-2 | 0.20 |
| Cpd-1 | $4.0 \times 10^{-2}$ |
| Cpd-2 | $1.9 \times 10^{-2}$ |

-continued

| | |
|---|---|
| HBS-1 | 0.30 |
| HBS-2 | $1.2 \times 10-2$ |
| Layer 2: Interlayer | |
| Fine Grain Silver Iodobromide (AgI 1.0 mol %, sphere-corresponding diameter 0.07 μm) | 0.15 as Ag |
| Gelatin | 1.00 |
| ExC-4 | $6.0 \times 10^{-2}$ |
| Cpd-3 | $2.0 \times 10^{-2}$ |
| Layer 3: Low Speed Red-Sensitive Emulsion Layer | |
| Silver Iodobromide in Silver Iodobromide Emulsion A | 0.42 as Ag |
| Silver Iodobromide in Silver Iodobromide Emulsion B | 0.40 as Ag |
| Gelatin | 1.90 |
| ExS-1 | $4.5 \times 10^{-4}$ mol |
| ExS-2 | $1.5 \times 10^{-4}$ mol |
| ExS-3 | $4.0 \times 10^{-5}$ mol |
| ExC-1 | 0.65 |
| ExC-3 | $1.0 \times 10^{-2}$ |
| ExC-4 | $2.3 \times 10^{-2}$ |
| HBS-1 | 0.32 |
| Layer 4: Medium Speed Red-Sensitive Emulsion Layer | |
| Silver Iodobromide in Silver Iodobromide Emulsion C | 0.85 as Ag |
| Gelatin | 0.91 |
| ExS-1 | $4.5 \times 10^{-4}$ mol |
| ExS-2 | $1.5 \times 10^{-4}$ mol |
| ExS-3 | $4.5 \times 10^{-5}$ mol |
| ExC-1 | 0.13 |
| ExC-2 | $6.2 \times 10^{-2}$ |
| ExC-4 | $4.0 \times 10^{-2}$ |
| ExC-6 | $3.0 \times 10^{-2}$ |
| HBS-1 | 0.10 |
| Layer 5: High Speed Red-Sensitive Emulsion Layer | |
| Silver Iodobromide in Silver Iodobromide Emulsion D | 1.50 as Ag |
| Gelatin | 1.20 |
| ExS-1 | $3.0 \times 10^{-4}$ mol |
| ExS-2 | $9.0 \times 10^{-5}$ mol |
| ExS-3 | $3.0 \times 10^{-5}$ mol |
| ExC-2 | $8.5 \times 10^{-2}$ |
| ExC-5 | $3.6 \times 10^{-2}$ |
| ExC-6 | $1.0 \times 10^{-2}$ |
| ExC-7 | $3.7 \times 10^{-2}$ |
| HBS-1 | 0.12 |
| HBS-2 | 0.12 |
| Layer 6: Interlayer | |
| Gelatin | 1.00 |
| Cpd 4 | $8.0 \times 10^{-2}$ |
| HBS-1 | $8.0 \times 10^{-2}$ |
| Layer 7: Low Speed Green-Sensitive Emulsion Layer | |
| Silver Iodobromide in Silver Iodobromide Emulsion E | 0.28 as Ag |
| Silver Iodobromide in Silver Iodobromide Emulsion F | 0.16 as Ag |
| Gelatin | 1.20 |
| ExS 4 | $7.5 \times 10^{-4}$ mol |
| ExS-5 | $3.0 \times 10^{-4}$ mol |
| ExS-6 | $1.5 \times 10^{-4}$ mol |
| ExM-1 | 0.50 |
| ExM-2 | 0.10 |
| ExM-5 | $3.5 \times 10^{-2}$ |
| HBS-1 | 0.20 |
| HBS-3 | $3.0 \times 10^{-2}$ |
| Layer 8: Medium Speed Green-Sensitive Emulsion Layer | |
| Silver Iodobromide in Silver Iodobromide Emulsion G | 0.57 as Ag |
| Gelatin | 0.45 |
| ExS-4 | $5.2 \times 10^{-4}$ mol |
| ExS-5 | $2.1 \times 10^{-4}$ mol |
| ExS-6 | $1.1 \times 10^{-4}$ mol |
| ExM-1 | 0.12 |
| ExM-2 | $7.1 \times 10^{-3}$ |
| ExM-3 | $3.5 \times 10^{-2}$ |

-continued

| | |
|---|---|
| HBS-1 | 0.15 |
| HBS-3 | $1.0 \times 10^{-2}$ |
| Layer 9: Interlayer | |
| Gelatin | 0.50 |
| HBS-1 | $2.0 \times 10^{-2}$ |
| Layer 10: High Speed Green-Sensitive Emulsion Layer | |
| Silver Iodobromide in Silver Iodobromide Emulsion H | 1.30 as Ag |
| Gelatin | 1.20 |
| ExS-4 | $3.0 \times 10^{-4}$ mol |
| ExS-5 | $1.2 \times 10^{-4}$ mol |
| ExS-6 | $1.2 \times 10^{-4}$ mol |
| ExM-4 | $5.8 \times 10^{-2}$ |
| ExM-6 | $5.0 \times 10^{-3}$ |
| ExC-2 | $4.5 \times 10^{-3}$ |
| Cpd-5 | $1.0 \times 10^{-2}$ |
| HBS-1 | 0.25 |
| Layer 11: Yellow Filter Layer | |
| Gelatin | 0.50 |
| Cpd-6 | $5.2 \times 10^{-2}$ |
| HBS-1 | 0.12 |
| Layer 12: Interlayer | |
| Gelatin | 0.45 |
| Cpd-3 | 0.10 |
| Layer 13: Low Speed Blue-Sensitive Emulsion Layer | |
| Silver Iodobromide in Silver Iodobromide Emulsion I | 0.20 as Ag |
| Gelatin | 1.00 |
| ExS-7 | $3.0 \times 10^{-4}$ mol |
| ExY-1 | 0.60 |
| ExY-2 | $2.3 \times 10^{-2}$ |
| HBS-1 | 0.15 |
| Layer 14: Medium Speed Blue-Sensitive Emulsion Layer | |
| Silver Iodobromide in Silver Iodobromide Emulsion J | 0.19 as Ag |
| Gelatin | 0.35 |
| ExS-7 | $3.0 \times 10^{-4}$ mol |
| ExY-1 | 0.22 |
| HBS-1 | $7.0 \times 10^{-2}$ |
| Layer 15: Interlayer | |
| Fine Grain Silver Iodobromide (AgI 2 mol %, uniform AgI type, sphere-corresponding diameter 0.13 μm) | 0.20 as Ag |
| Gelatin | 0.36 |
| Layer 16: 3rd Blue-Sensitive Emulsion Layer | |
| Silver Iodobromide in Silver Iodobromide Emulsion K | 1.55 as Ag |
| Gelatin | 1.00 |
| ExS-8 | $2.2 \times 10^{-4}$ mol |
| ExY-1 | 0.21 |
| HBS-1 | $7.0 \times 10^{-2}$ |

-continued

| | |
|---|---|
| Layer 17: 1st Protective Layer | |
| Gelatin | 1.80 |
| UV-1 | 0.13 |
| UV 2 | 0.21 |
| HBS-1 | $1.0 \times 10^{-2}$ |
| HBS-2 | $1.0 \times 10^{-2}$ |
| Layer 18: 2nd Protective Layer | |
| Fine Grain Silver Chloride (sphere-corresponding diameter 0.07 μm) | 0.36 as Ag |
| Gelatin | 0.70 |
| B-1 (diameter 1.5 m) | $2.0 \times 10^{-2}$ |
| B-2 (diameter 1.5 m) | 0.15 |
| B-3 | $3.0 \times 10^{-2}$ |
| W-1 | $2.0 \times 10^{-2}$ |
| H-1 | 0.35 |
| Cpd-7 | 1.00 |

The sample further contained 1,2-benzisothizaolin-3-one (200 ppm in average to gelatin), n-butyl-p-hydroxybenzoate (about 1,000 ppm to gelatin), and 2-phenoxyethanol (about 10,000 ppm to gelatin). Furthermore, the sample contains B-4, B-5, W-2, W-3, F-1, F-2, F-3, F-4, F-5, F-6, F-7, F-8, F-9, F-10, F-11, F-12, F-13, F-14, F-15, an iron salt, a lead salt, a gold salt, a platinum salt, F-14, F-15, an iridium salt, and a rhodium salt.

TABLE 1

| Emulsion | Average AgI content (mol %) | Diameter in terms of sphere (μm) | Grain diameter variation coefficient (%) | Average diameter in terms of sphere (μm) | Average thickness (μm) | Grain structure | Shape |
|---|---|---|---|---|---|---|---|
| A | 9 | 0.75 | 18 | 1.16 | 0.21 | Triple | Tabular |
| B | 3 | 0.50 | 10 | 0.50 | 0.50 | Triple | Cubic |
| C | 9 | 0.83 | 15 | 1.32 | 0.22 | Triple | Tabular |
| D | 5 | 1.20 | 15 | 1.90 | 0.32 | Triple | Tabular |
| E | 5 | 0.70 | 18 | 1.13 | 0.18 | Triple | Tabular |
| F | 3 | 0.48 | 10 | 0.48 | 0.48 | Triple | Octahedral |
| G | 7 | 0.80 | 15 | 1.25 | 0.22 | Triple | Tabular |
| H | 4.5 | 1.15 | 15 | 1.97 | 0.26 | Triple | Tabular |
| I | 1.5 | 0.55 | 20 | 0.90 | 0.14 | Triple | Tabular |
| J | 8 | 0.80 | 16 | 1.19 | 0.24 | Triple | Tabular |
| K | 7 | 1.45 | 14 | 2.31 | 0.38 | Triple | Tabular |

The following can be noted with respect to the emulsions of Table 1.

Table 1 demonstrates the following facts:

(1) These emulsions were each subjected to reduction sensitization with thiourea dioxide and thiosulfonic acid during the preparation of grains in accordance with an example described in JP-A-2-191938;

(2) In these emulsions, the light-sensitive layers were each subjected to gold sensitization, sulfur sensitization and selenium sensitization in the presence of the spectral sensitizing dye shown hereinabove and further in the presence of sodium thiocyanate in accordance with an example described in JP-A-3-237450; and (3) The preparation of tabular grains was conducted using a low molecular weight gelatin in accordance with an example described in JP-A-1-158426.

The tabular grains and regular crystal grains having a grain structure were observed having a transition line described in JP-A-3-237450 under a high voltage electron microscope.

The compounds used for preparing the foregoing sample are as follows.

UV-1
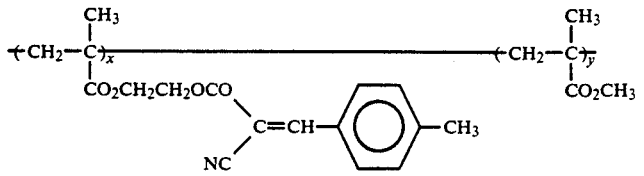
x/y = 7/3
(by weight)
UV-2
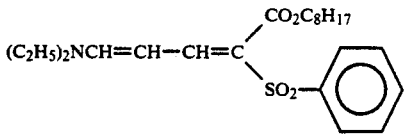
In the present invention an alkyl group having no n-, i- or t- symbol represents a n-alkyl group.
ExC-1
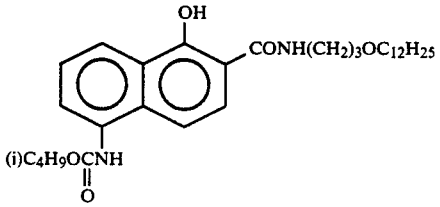
ExC-2
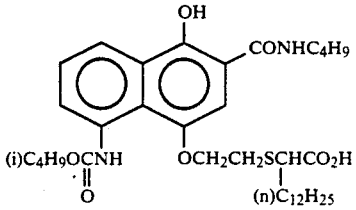
ExC-3
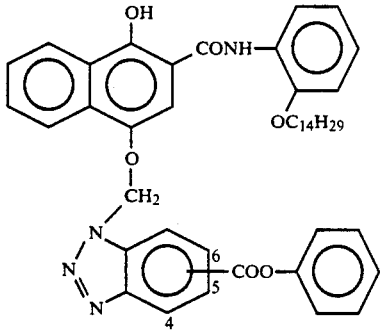
(A mixture of compounds substituted at 5- or 6-position. The same hereinafter.)
ExC-4
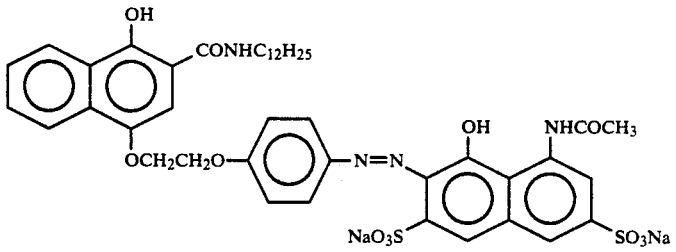
ExC-5
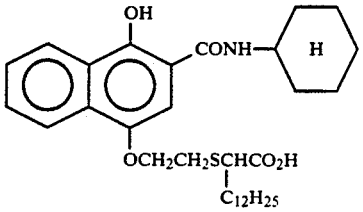

-continued
ExC-6
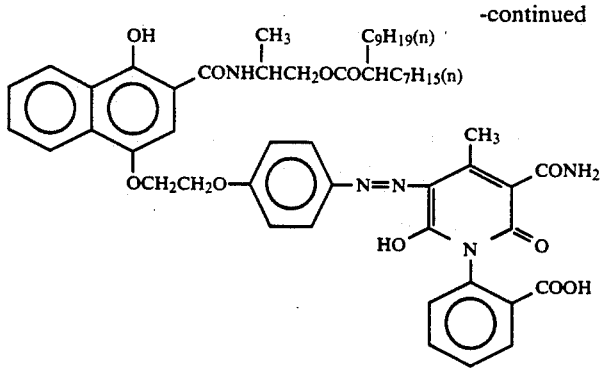
ExC-7
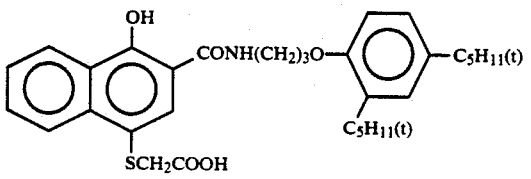
ExM-1
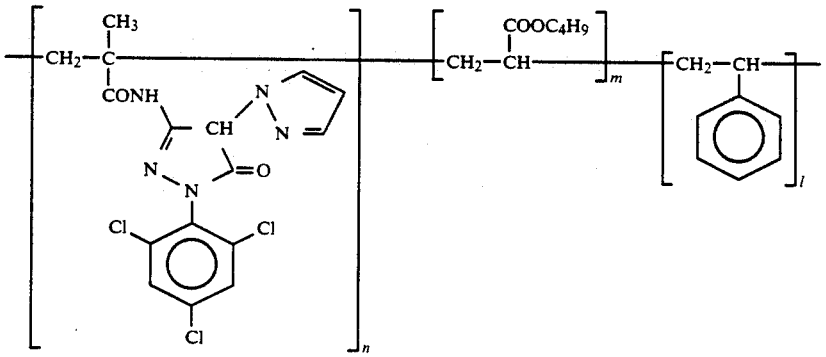
n:m l = 2:1:1
(weight proportion)
Average molecular weight: 20,000
ExM-2
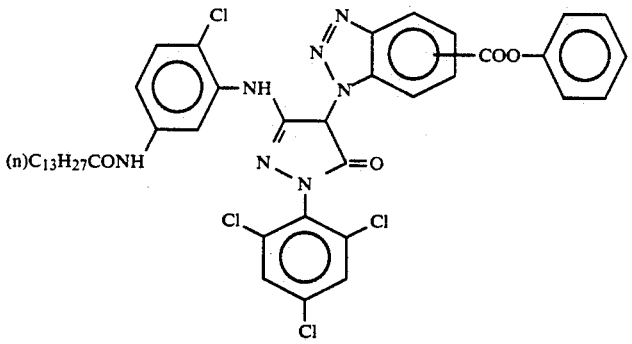
ExM-3
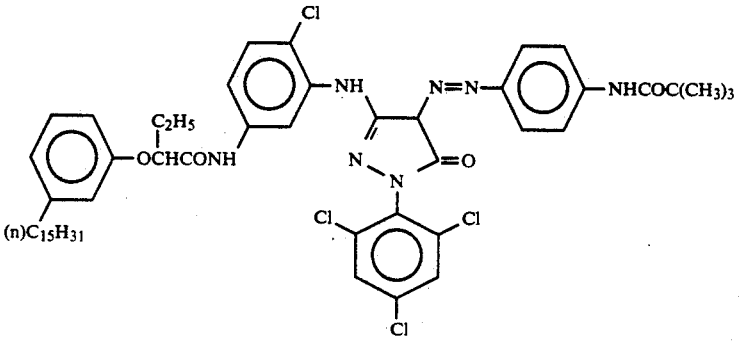

-continued
ExM-4
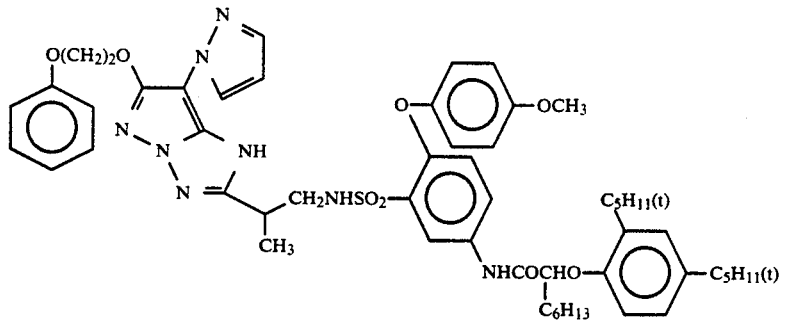
ExM-5
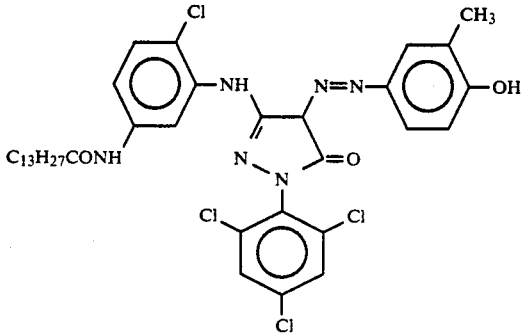
ExM-6
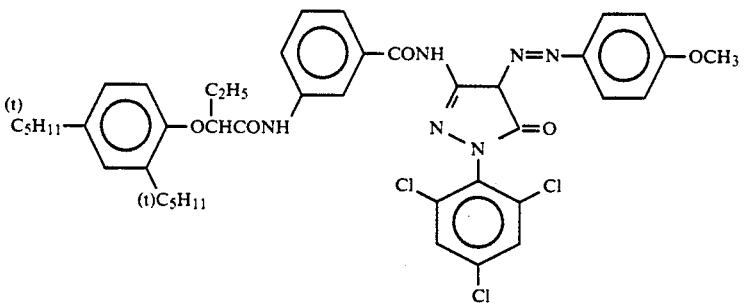
ExY-1
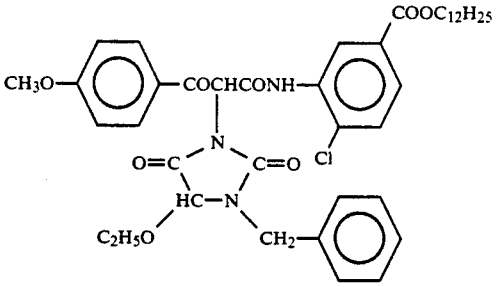
ExY-2
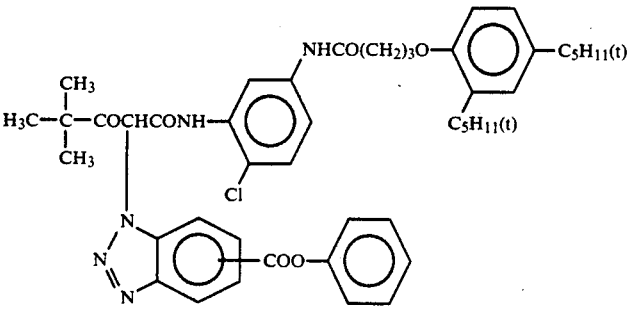

-continued
Cpd-1
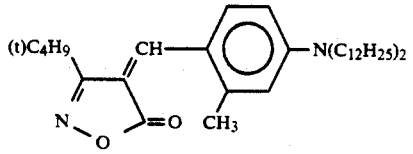
Cpd-2
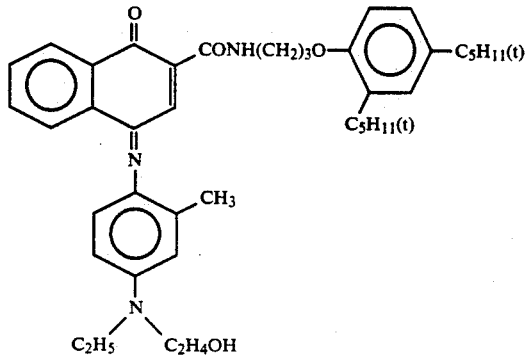
Cpd-3
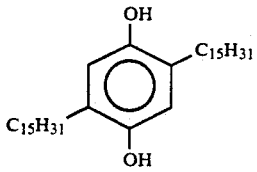
Cpd-4
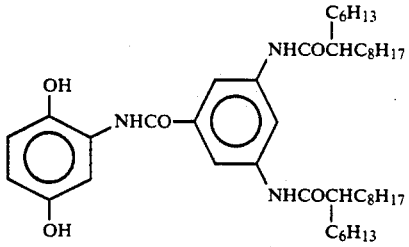
Cpd-5
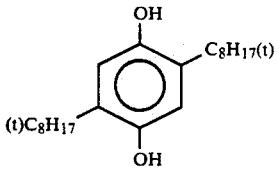
Cpd-6
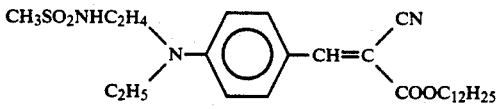
Cpd-7
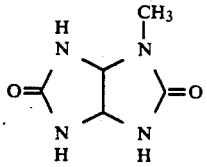
HBS-1
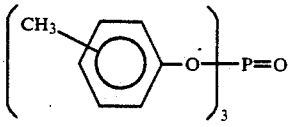

-continued
HBS-2
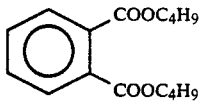
HBS-3
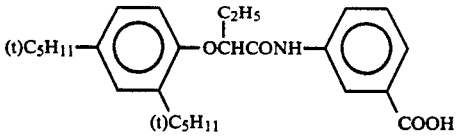
ExS-1
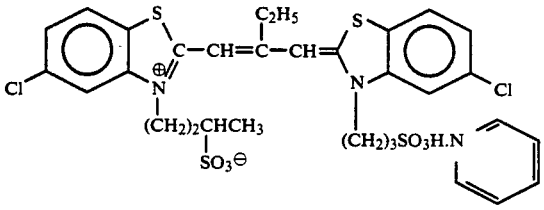
ExS-2
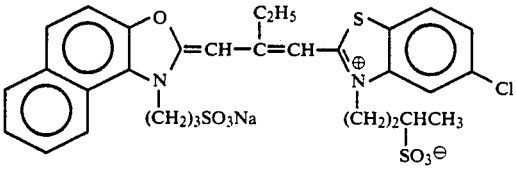
ExS-3
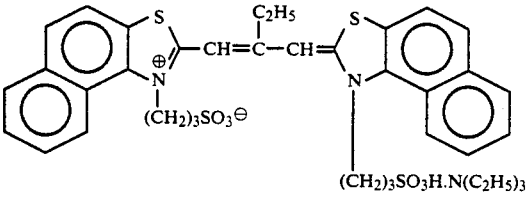
ExS-4
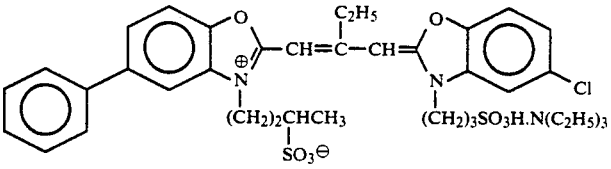
ExS-5
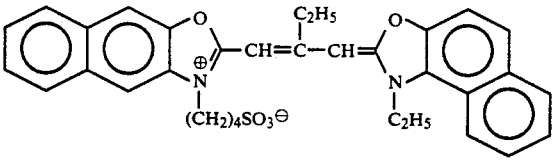
ExS-6
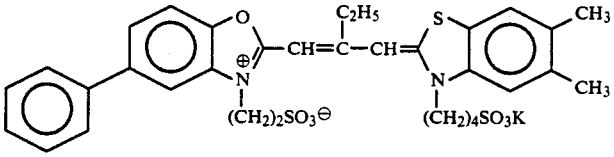
ExS-7
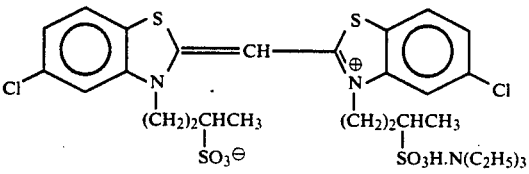

-continued
ExS-8
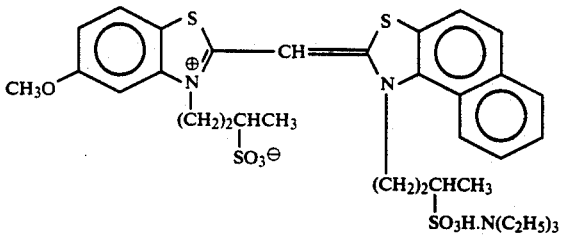
B-1
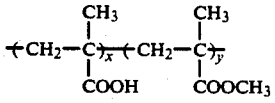
x/y = 10/90 (by weight)
B-2
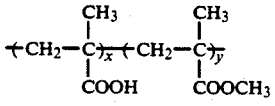
x/y = 40/60 (by weight)
B-3
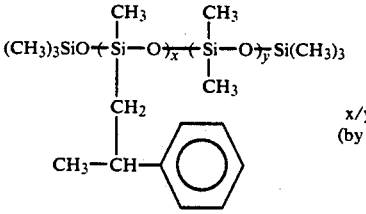
x/y = 29/46 (by weight)
B-4
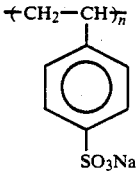
B-5
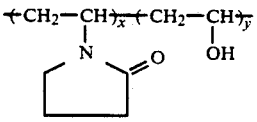
x/y = 70/30 (by weight)
B-6
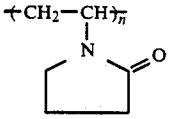
(mol. wt. about 10,000)
W-1
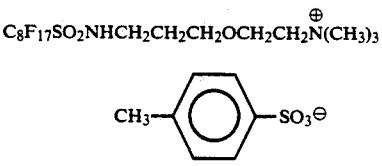
W-2
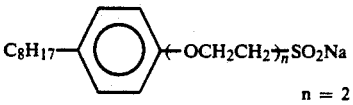
n = 2~4
W-3
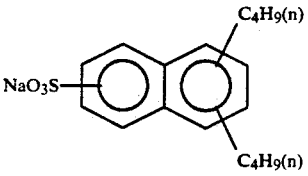

-continued
H-1
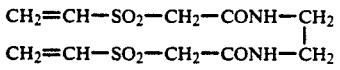
F-1
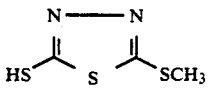
F-2
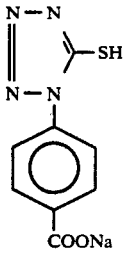
F-3
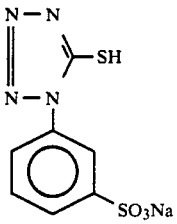
F-4
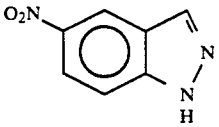
F-5
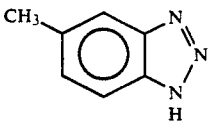
F-6
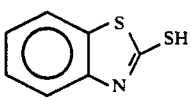
F-7
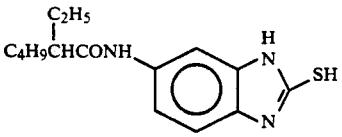
F-8
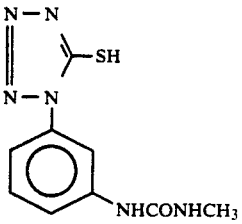
F-9
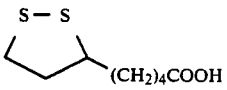

-continued

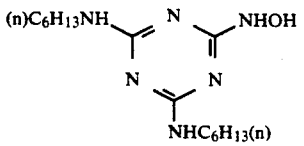

F-10

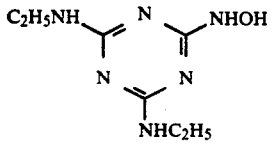

F-11

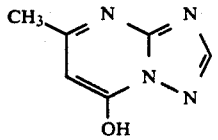

F-12

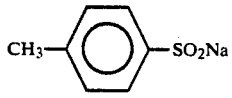

F-13

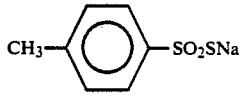

F-14

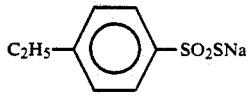

F-15

The multilayer color photographic material A thus prepared was sliced into width of 35 mm, subjected to a wedge exposure of white light (color temperature of the light source 4800° K.), and processed by the following processing steps using a cine automatic processor. In this case, however, the multilayer color photographic material A for evaluating the performance was processed after processing an imagewise-exposed sample until the accumulated amount of the replenisher for the color developer became thrice the tank volume.

(Processing Steps)

| Step | Time | Temperature (°C.) | Replenisher Amount* (ml) | Tank Volume (liter) |
|---|---|---|---|---|
| Color Development | 3 min. 15 sec. | 37.8 | 23 | 10 |
| Bleach | 50 sec. | 38.0 | 5 | 5 |
| Fix | 100 sec. | 38.0 | 30 | 10 |
| Wash (1) | 30 sec. | 38.0 | — | 5 |
| Wash (2) | 20 sec. | 38.0 | 30 | 5 |
| Stabilization | 20 sec. | 38.0 | 20 | 5 |
| Drying | 1 min. | 55 | | |

*The replenishing amount is an amount per 1 meter × 35 mm.

Wash was a countercurrent system from (2) to (1).

In addition, the carried amount of the color developer into the bleaching step and the carried amount of the fixing solution into the washing step were 2.5 ml and 2.0 ml, respectively per a meter length×35 mm width of the color photographic material. In the aeration condition of the bleaching solution, the bleaching carried was out while bubbling at 200 ml/min through a conduit portion having a large number of fine holes having a diameter of 0.2 mm equipped to the bottom of the bleaching solution tank.

Also, each crossover time was 5 seconds, which was included in the processing time of the previous step.

Next, the compositions of the processing solutions are shown below.

| | Tank Solution | Replenisher |
|---|---|---|
| (Color Developer) | | |
| Diethylenetriaminepentaacetic Acid | 1.0 g | 1.1 g |
| 1-Hydroxyethylidene-1,1-diphosphonic Acid | 3.0 g | 3.2 g |
| Sodium Sulfite | 4.0 g | 4.9 g |
| Potassium Carbonate | 30.0 g | 30.0 g |
| Potassium Bromide | 1.4 g | — |
| Potassium Iodide | 1.5 mg | — |
| Hydroxylamine Sulfate | 2.4 g | 3.6 g |
| 4-(N-Ethyl-N-β-hydroxyethylamino)-2-methylaniline Sulfate | 4.5 g | 6.4 g |
| Water to make | 1 liter | 1 liter |
| pH | 10.05 | 10.10 |
| (Bleach Solution) | | |
| Iron Nitrate.$9H_2O$ | 0.35 mol | 0.53 mol |
| Chelate Compound (shown in Table A) | 0.55 mol | 0.83 mol |
| Ammonium Bromide | 100 g | 150 g |
| Ammonium Nitrate | 20 g | 30 g |
| Glycolic Acid | 55 g | 83 g |
| Water to make | 1 liter | 1 liter |
| pH | 5.0 | 5.0 |

In this case, the chelate compound shows an organic acid which reacts with iron nitrate.$9H_2O$ to form an organic acid ferric ammonium salt (a chelate compound of the invention) acting as a bleaching agent. (The same in the following examples).

| Fixing solution (common to both tank solution and replenisher) | (unit: g) |
|---|---|
| Ferric ammonium ethylenediaminetetra-acetate | 1.7 |
| Ammonium sulfite | 14.0 |
| Aqueous solution of ammonium thiosulfate (700 g/l) | 260.0 ml |
| Water to make | 1,000 ml |
| pH | 7.0 |

Rinsing Solution (Common To Both Tank Solution And Replenisher)

Tap water was passed through a mixed bed column filled with an H type strongly acidic cation exchange resin (Amberlite IR-120B produced by Rohm & Haas) and an OH type strongly basic anion exchange resin (Amberlite IRA-400) so that the calcium and magnesium ion concentrations were each reduced to 3 mg/l or less. To the solution were then added 20 mg/l of dichlorinated sodium isocyanurate and 150 mg/l of sodium sulfate. The pH range of the solution was from 6.5 to 7.5.

| Stabilizing solution (common to both tank solution and replenisher | |
|---|---|
| 37% Formalin | 1.2 ml |
| Surface active agent $[C_{10}H_{21}—O—(CH_2CH_2O)_{10}—H]$ | 0.4 g |
| Ethylene glycol | 1.0 g |
| Water to make | 1.0 l |
| pH | 5.0–7.0 |

For the multilayer color photographic material A processed as described above, the residual amount of silver at the maximum color density portion was measured by an X-ray fluorescence analysis.

Also, on each of these multilayer color photographic materials A thus processed, the density was measured and from the characteristic curve, each of the Dmin Values measured by green light (G light) was read.

Then, the bleaching solution was replaced with the bleaching solution having the following formula as a standard bleaching solution giving no bleaching fog and the multilayer color photographic material A was processed at a bleaching time of 390 seconds, a processing temperature of 38° C., and at a replenishing amount of 25 ml per 35 mm×1 meter of the color photographic material, while not changing the other conditions.

| (Standard Bleach Solution) | Tank Solution | Replenisher |
|---|---|---|
| Ferric Sodium Ethylenediaminetertraacetate Trihydrate | 100.0 g | 120.0 g |
| Disodium Ethylenediaminetertraacetate | 10.0 g | 11.0 g |
| Ammonium Bromide | 100 g | 120 g |
| Ammonium Nitrate | 30.0 g | 35.0 g |
| Aqueous Ammonia (27%) | 6.5 ml | 4.0 ml |
| Water to make | 1 liter | 1 liter |
| pH | 6.0 | 5.7 |

On each multilayer color photographic material processed using the foregoing standard bleach solution, the density was measured and from the characteristics curve, Dmin was read.

The difference ΔDimn value between the Dmin value of each multilayer color photographic material A obtained in foregoing processing and the standard Dmin value obtained using the standard bleach solution was determined. In addition, the Dmin value obtained using the standard bleach solution was 0.60.

Bleach fog ($\Delta D$min) =
($D$min with each sample) −
($D$min with the standard bleach solution)

The light-fastness of dyes was determined as follows:

Light-fastness: The specimens processed were put in a fluorescent lamp tester where they were then continuously irradiated on the emulsion layer side with light of 17,000 lux for 3 days. During this period, the discoloration of the yellow dye was determined by the change in the yellow density measured by an X-Light 310 type photographic densitometer.

The results are set forth in Table A.

TABLE A

| No. | Chelate compound | Amount of residual silver [μg/cm²] | Bleach fog ΔDmin (G) | Stain rise ΔD (G) | Light-fastness | Remarks |
|---|---|---|---|---|---|---|
| 301 | Comparative compound A | 15.2 | 0.00 | 0.35 | 0.20 | Comparative Example |
| 302 | Comparative compound B | 4.3 | 0.25 | 0.17 | 0.18 | " |
| 303 | Comparative compound C | 5.1 | 0.02 | 0.07 | 0.32 | " |
| 304 | Comparative compound D | 5.2 | 0.03 | 0.07 | 0.33 | " |
| 305 | Invention compound 1 | 3.8 | 0.06 | 0.09 | 0.11 | Present Invention |
| 306 | Invention compound 2 | 3.4 | 0.07 | 0.08 | 0.12 | " |
| 307 | Invention compound 3 | 3.4 | 0.07 | 0.06 | 0.18 | " |
| 308 | Invention compound 7 | 3.6 | 0.06 | 0.07 | 0.16 | " |
| 309 | Invention compound 9 | 3.2 | 0.08 | 0.06 | 0.11 | " |
| 310 | Invention compound 11 | 4.0 | 0.06 | 0.08 | 0.12 | " |
| 311 | Invention | 3.9 | 0.07 | 0.10 | 0.15 | " |

TABLE A-continued

| No. | Chelate compound | Amount of residual silver [μg/cm²] | Bleach fog ΔDmin (G) | Stain rise ΔD (G) | Light-fastness | Remarks |
|---|---|---|---|---|---|---|
| | compound 13 | | | | | |

Comparison Compound A:

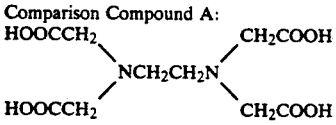

Comparison Compound B:

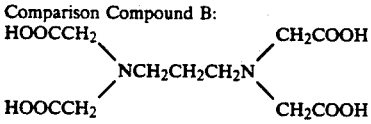

Comparison Compound C

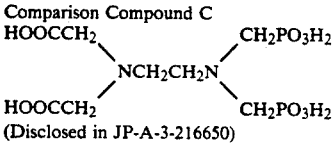

(Disclosed in JP-A-3-216650)

Comparison Compound D

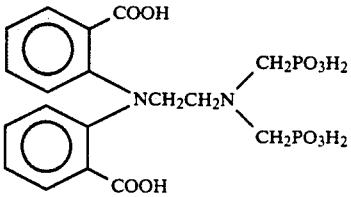

-continued (Disclosed in JP-A-3-216650)

From the results shown in Table A, it can be seen that the metal chelate compounds for use in this invention can reduce the residual amount of silver and show excellent effects in the bleach fog and stains upon storing color images after processing as compared with the case of using the comparison compounds.

EXAMPLE 2

In Sample No. 214 (multilayer color photographic paper) described in Example 2 of JP-A-2-139544 (corresponding to U.S. Pat. No. 5,122,444), III-10 was used in place of III-23 described in the above patent application as the bisphenol compound, the yellow coupler (ExY), the cyan coupler (ExC), the dye image stabilizer (Cpd-8), the solvent (Solv-6), and the oxonol dyes were changed with the following compounds, and also the following antiseptics (antibacterial and antifungal agent) was further used to provide multilayer color photographic paper B.

(ExY) Yellow Coupler

A 1:1 (mol ratio) mixture of:

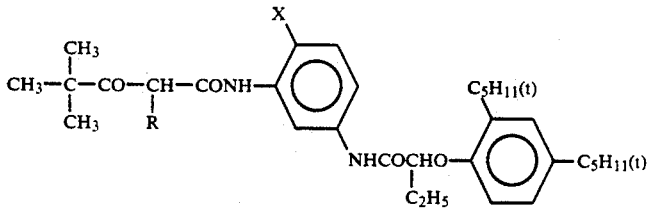

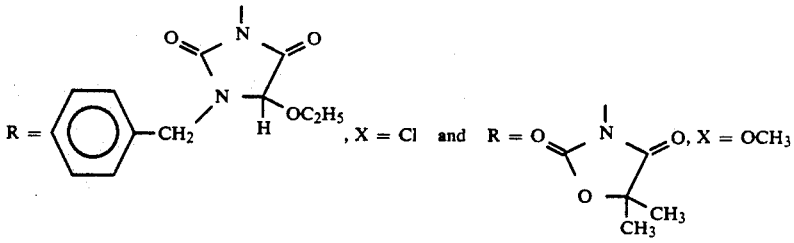

(ExC) Cyan Coupler:

A 1:1:1 (mol ratio) mixture of:

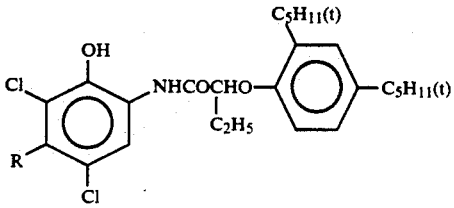

-continued
R = $CH_3$ and R = $C_2H_5$, and
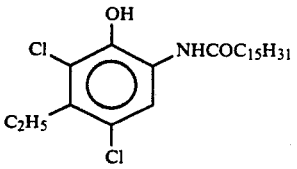
(Cpd-8) Dye Image Stabilizer:
A 1:1 (mol ratio) mixture of:
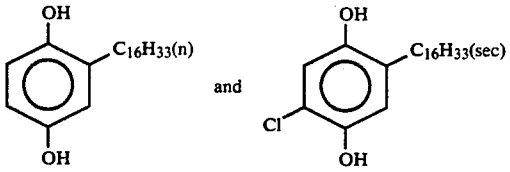
(Cpd-10) Antiseptics:
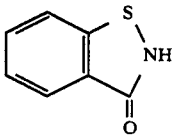
(25.0 mg/m$^2$)
(Cpd-11) Antiseptics:
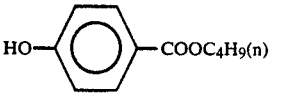
(50.0 mg/m$^2$)
(Solv-6) Solvent:
A 9:1 (weight ratio) mixture of:
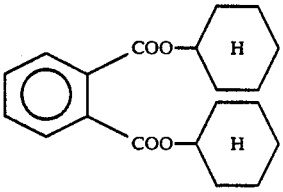
and $(n)C_8H_{17}CHCH(CH_2)_7COOC_8H_{17}(n)$ (O)
(Oxonol Dyes)
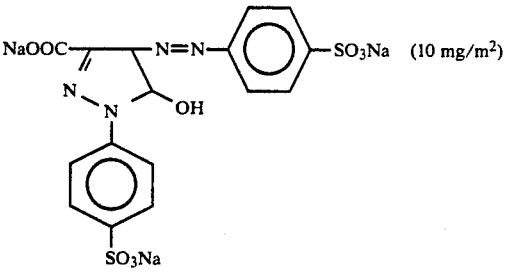
(10 mg/m$^2$)
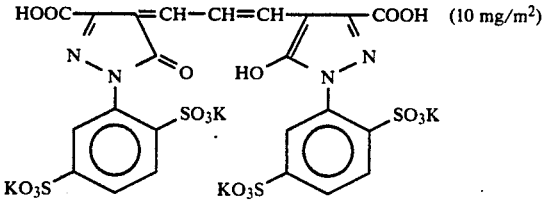
(10 mg/m$^2$)

-continued

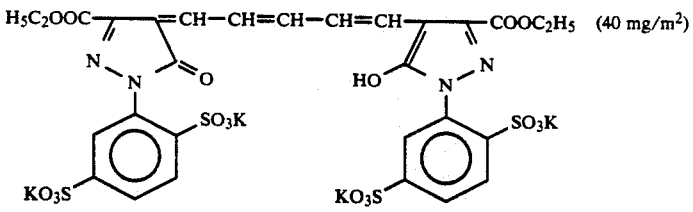

and

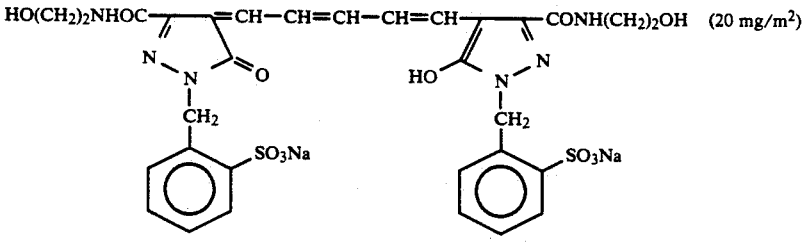

Processing solutions having the following compositions were prepared.

| | |
|---|---|
| (Color Developer) | |
| Water | 600 ml |
| Ethylenediamine-N,N,N',N'-tetra-methylenephosphonic Acid | 2.0 g |
| Potassium Bromide | 0.015 g |
| Potassium Chloride | 3.1 g |
| Triethanolamine | 10.0 g |
| Potassium Carbonate | 27 g |
| Optical Whitening Agent (WHITE X.4B, trade name, made by Sumitomo Chemical Company, Limited) | 1.0 g |
| Diethylhydroxylamine | 4.2 g |
| N-Ethyl-N-(β-methanesulfonamido-ethyl)-3-methyl-4-aminoaniline Sulfate | 5.0 g |
| Water to make | 1 liter |
| pH (25° C.) | 10.05 |
| (Blix Solution) | |
| Water | 400 ml |
| Ammonium Thiosulfate (700 g/liter) | 100 ml |
| Sodium Thiosulfate | 17 g |
| Iron Chloride | 0.50 mol |
| Chelate compound (shown in Table B) | 0.55 mol |
| Ammonium Bromide | 40 g |
| Water to make | 1 liter |
| pH (25° C.) | 6.8 |
| (Rinse Solution) | |
| Ion-exchanged water (concentrations of calcium and magnesium each lower than 3 ppm) | |

The multilayer color photographic paper B was processed in the following processing steps.

(Processing Steps)

| Step | Temperature | Time |
|---|---|---|
| Color Development | 38° C. | 45 sec. |
| Blix | 35° C. | 25 sec. |
| Rinse (1) | 35° C. | 20 sec. |
| Rinse (2) | 35° C. | 20 sec. |
| Rinse (3) | 35° C. | 20 sec. |
| Drying | 80° C. | 60 sec. |

Furthermore, the multilayer color photographic paper B uniformly exposed such that the gray density became 1.5 was processed by the same manner as above and the residual silver amount in the maximum density portion of each sample was determined by an X-ray fluorescence analysis.

The results obtained are shown in Table B.

TABLE B

| No. | Chelate compound | Amount of residual silver [μg/cm²] | Remarks |
|---|---|---|---|
| 401 | Comparative Compound A | 14.0 | Comparative Example |
| 402 | Invention Compound 1 | 2.7 | Present Invention |
| 403 | Invention Compound 3 | 1.7 | " |
| 404 | Invention Compound 7 | 2.0 | " |
| 405 | Invention Compound 9 | 1.7 | " |

Comparison Compound A is the same Comparison Compound A in Example 1.

From the above results in Table B, it can be seen that in the case of using the metal chelate compounds in this invention, the residual silver amount is less than the case of using Comparison Compound A.

EXAMPLE 3

The multilayer color photographic material A as in Example 1 was exposed to white light of a color temperature of 4800° K. through a wedge and processed by the following processing steps.

(Processing Steps)

| | Step | Temperature Time (°C.) | Replenisher Amount* (ml) | Tank Volume (liter) |
|---|---|---|---|---|
| Color Development | 1 min. | 48 | 10 | 2 |
| Bleach | 20 sec. | 48 | 10 | 1 |
| Fix | 40 sec. | 48 | 30 | 1 |
| Washing with water | 20 sec. | 40 | 30 | 1 |
| Stabilizing | 10 sec. | 40 | 30 | 1 |
| Drying | 40 sec. | 60 | | |

*The replenishing amount is per 1 meter × 35 mm of the color photographcc paper.

| | Tank Solution | Replenisher |
|---|---|---|
| (Color Developer) | | |
| Diethylenetriaminepenta-acetic Acid | 2.2 g | 2.2 g |
| 1-Hydroxyethylidene-1,1-diphosphonic Acid | 3.0 g | 3.2 g |
| Sodium Sulfite | 4.1 g | 4.9 g |
| Potassium Carbonate | 40 g | 40 g |
| Potassium Bromide | 1.4 g | 0.4 g |
| Potassium Iodide | 1.3 mg | — |
| 2-Methoxy-4-[N-ethyl-N-(β-hydroxyethylamino]aniline Sulfate | 6.9 g | 9.2 g |
| Water to make | 1 liter | 1 liter |
| pH (adjusted with 50% KOH) | 10.05 | 10.25 |
| (Bleach Solution) | | |
| Chelate Compound (shown in Table C) | 0.47 mol | 0.67 mol |
| Iron Nitrate.$9H_2O$ | 0.3 mol | 0.43 mol |
| Ammonium Bromide | 80 g | 114 g |
| Ammonium Nitrate | 15 g | 21.4 g |
| Acetic Acid (90%) | 42 g | 60 g |
| Water to make | 1 liter | 1 liter |
| pH | 4.3 | 3.8 |
| (Fixing Solution) | Tank Solution = Replenisher | |
| Aqueous Ammonium Thiosulfate Solution (700 g/liter) | 280 ml | |
| 1-Hydroxyethylidene-1,1-diphosphonic Acid | 10 g | |
| Ammonium Sulfite | 28 g | |
| Water to make | 1 liter | |
| pH | 7.8 | |
| Stabilizing solution (common to running solution and replenisher) | | |
| Water | 900 ml | |
| Pyrazole | 4.0 g | |
| Formalin (37% solution of formaldehyde) | 1.5 ml | |
| Polyoxyethylene-p-monononyl-phenylether (average poly-merization degree: 10) | 0.3 g | |
| Disodium ethylenediaminetetra-acetate | 0.05 g | |
| Water to make | 1,000 ml | |
| pH | 5.8 | |

The processing was carried out until the accumulated amount of each replenisher became twice the tank volume, and at that time the processing property was evaluated.

The evaluation of the processing property was carried out by measuring the residual amount at the maximum color density portion, measuring the bleach fog, and measuring the increase of stains under the dark, wet, and heat condition as in Example 1.

The results obtained are shown in Table C.

TABLE C

| No. | Chelate Compound | Amount of residual silver [μ/cm²] | Bleach fog ΔDmin (G) | Stain rise after Processing ΔD (G) | Remarks |
|---|---|---|---|---|---|
| 501 | Comparative Compound A | 30.0 | 0.03 | 0.32 | Comparative Example |
| 502 | Comparative Compound B | 7.1 | 0.35 | 0.28 | " |
| 503 | Invention Compound 1 | 5.0 | 0.10 | 0.13 | Present Invention |
| 504 | Invention Compound 3 | 4.6 | 0.08 | 0.08 | " |
| 505 | Invention Compound 15 | 4.8 | 0.09 | 0.10 | " |
| 506 | Invention Compound 17 | 5.2 | 0.08 | 0.12 | " |

The comparison compounds are the same those in Example 1.

As is clear from the results shown in Table C, it can be seen that the bleaching solutions containing the metal chelate compounds for use in this invention as the bleaching agents are excellent in the desilvering property, the prevention of bleach fog, and the prevention of stains after processing as compared with the comparison bleach solutions.

Also, the same evaluation as above was carried out except that the foregoing bleaching solution was replaced with the bleaching solution having the following formula.

| (Bleaching Solution) | Tank Solution | Replenisher |
|---|---|---|
| Metal Chelate Compound (shown in Table D) | 0.3 mol | 0.43 mol |
| Ammonium Bromide | 80 g | 114 g |
| Ammonium Nitrate | 15 g | 21.4 g |
| Nitric Acid (90%) | 42 g | 60 g |
| Water to make | 1 liter | 1 liter |
| pH | 4.3 | 3.8 |

The results obtained are shown in Table D.

TABLE D

| No. | Metallic Chelate Compound | Amount of residual silver [μg/cm²] | Bleach fog ΔDmin (G) | Stain rise after Processing ΔD (G) | Remarks |
|---|---|---|---|---|---|
| 601 | Comparative Compound E | 30.0 | 0.02 | 0.33 | Comparative Example |
| 602 | Comparative Compound F | 7.1 | 0.35 | 0.28 | " |
| 603 | Invention Compound K-3 | 4.5 | 0.06 | 0.08 | Present Invention |
| 604 | Invention Compound K-5 | 3.0 | 0.04 | 0.19 | " |
| 605 | Invention Compound K-7 | 5.4 | 0.04 | 0.18 | " |

The comparison compounds E and F shown in Table D are as shown below.

Comparison Compound E:

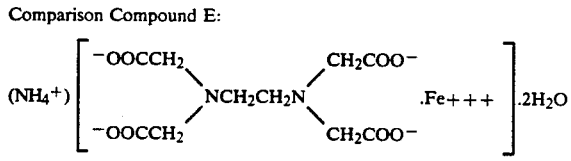

Comparison Compound F:

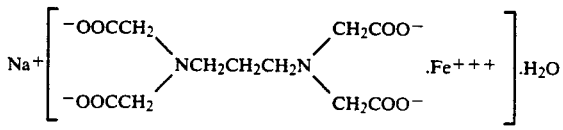

As is clear from Table D, it can be seen that even when the metal chelate compound for use in this invention is used as an isolated compound, the processing solution prepared using the compound is excellent in the desilvering property, the bleach fog, and stains after processing.

The processing solutions containing the metal chelate compound of the present invention has the following advantages.

(1) Desilvering processing can be quickly carried out without the formation of bleach fog and with less formation of stains after processing.

(2) Deviation of the processing performance before and after running processing is less.

While the invention has been described in detail and with reference to specific embodiments thereof, it will be apparent to one skilled in the art that various changes and modifications ca be made therein without departing from the spirit and scope thereof.

What is claimed is:

1. A method for processing a silver halide color photographic material which has been imagewise exposed and developed in a developing solution, which method comprises processing the material with a processing solution containing at least one chelate compound of a metal salt selected from the group consisting of salts of Fe(III), Mn(III), Co(III), Rh(II), Rh(III), Au(II), Au(III) and Ce(IV) with an organic acid or a salt thereof, wherein said organic acid is represented by the following general formula (I):

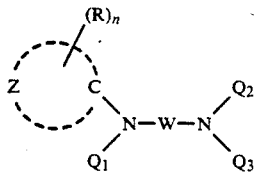

(I)

wherein Z represents a nonmetallic atom group required to form a heterocyclic group; R represents a substituent; n represents 0 or an integer of from 1 to 10; $Q_1$, $Q_2$, and $Q_3$ each represents a hydrogen atom, an aliphatic hydrocarbon group substituted by a carboxyl group, an aromatic hydrocarbon group substituted by a carboxyl group or a heterocyclic group substituted by a carboxyl group; and W represents a divalent linkage group containing at least one of an alkylene group, or an arylene group.

2. The method for processing a color photographic material as claimed in claim 1, wherein said heterocyclic group formed by Z or represented by $Q_1$, $Q_2$ or $Q_3$ each is a 3- to 10-membered saturated or unsaturated, monocyclic or condensed heterocyclic group containing at least one of a nitrogen atom, an oxygen atom and a sulfur atom.

3. The method for processing a color photographic material as claimed in claim 2, wherein said heterocyclic group is a pyridine, pyrazine, pyrimidine, pyridazine, triazine, tetrazine, thiophene, furan, pyran, pyrrole, imidazole, pyrazole, thiazole, isothiazole, oxazole, isooxazole, oxadiazole, thiadiazole, thianthrene, isobenzofuran, chromene, xanthene, phenoxthine, indolizine, isoindole, indole, triazole, triazolium, tetrazole, quinolizine, isoquinoline, quinoline, phthalazine, naphthyridine, quinoxaline, quinazoline, cinnoline, carbazole, carboline, phenanthridine, acridine, pteridine, phenanthroline, phenazine, phenothiazine, phenoxazine, chroman, pyrroline, pyrazoline, indoline, or isoindoline ring.

4. The method for processing a color photographic material as claimed in claim 1, wherein the aliphatic hydrocarbon group, aromatic hydrocarbon group and the heterocyclic group represented by $Q_1$, $Q_2$ or $Q_3$ is further substituted with at least one of an alkyl group, an aralkyl group, an alkenyl group, an alkinyl group, an alkoxy group, an aryl group, an amino group, an acylamino group, an alkylsulfonylamino group, an arylsulfonylamino group, a ureido group, an alkoxycarbonylamino group, an aryloxycarbonylamino group, an aryloxy group, a sulfamoyl group, a carbamoyl group, an alkylthio group, an arylthio group, an alkylsulfonyl group, an arylsulfonyl group, an alkylsulfinyl group, an arylsulfinyl group, a hydroxy group, a halogen atom, a cyano group, a sulfo group, a carboxyl group, a phosphono group, an aryloxycarbonyl group, an acyl group, an alkoxycarbonyl group, an acyloxy group, a carbonamido group, a sulfonamido group, a nitro group, a hydroxamic acid group, and further substituted groups thereof with at least one of these groups.

5. The method for processing a color photographic material as claimed in claim 1, wherein R represents an alkyl group, an aralkyl group, an alkenyl group, an alkinyl group, an alkoxy group, an aryl group, an amino group, an acylamino group, an alkylsulfonylamino group, an arylsulfonylamino group, a ureido group, an alkoxycarbonylamino group, an aryloxycarbonylamino group, an aryloxy group, a sulfamoyl group, a carbamoyl group, an alkylthio group, an arylthio group, an alkylsulfonyl group, an arylsulfonyl group, an alkylsulfinyl group, an arylsulfinyl group, a hydroxy group, a halogen atom, a cyano group, a sulfo group, a carboxyl group, a phosphono group, an aryloxycarbonyl group, an acyl group, an alkoxycarbonyl group, an acyloxy group, a carbonamido group, a sulfonamido group, a nitro group, a hydroxamic acid group, and further substituted groups thereof with at least one of these groups.

6. The method for processing a color photographic material as claimed in claim 1, wherein said divalent linking group represented by W is a group represented by general formula (W):

$$-(W^1-D)_m-W^2- \qquad (W)$$

wherein $W^1$ and $W^2$ may be the same or different and each represents a $C_{1-10}$ straight-chain, branched or cyclic alkylene group, a $C_{6-10}$ arylene group, or a $C_{7-10}$ aralkylene group; and D represents —O—, —S—, —N(Pw)— or a divalent nitrogen-containing heterocyclic group in which Pw represents a hydrogen atom or a $C_{1-8}$ alkyl group or $C_{6-10}$ aryl group which may be substituted by $-COOM_1$, $-PO_3M_2M_3$, —OH or $-SO_3M_4$ (in which $M_1$, $M_2$, $M_3$ and $M_4$ each represents a hydrogen atom or a cation), Said cycloalkylene group, arylene group and aralkylene group each may be condensed with a 5- or 6-membered ring, and m represents an integer of from 0 to 3.

7. The method for processing a color photographic material as claimed in claim 1, wherein said divalent linking group represented by W is a substituted group with an alkyl group, an aralkyl group, an alkenyl group, an alkinyl group, an alkoxy group, an aryl group, an amino group, an acylamino group, an alkylsulfonylamino group, an arylsulfonylamino group, a ureido group, an alkoxycarbonylamino group, an aryloxycarbonylamino group, an aryloxy group, a sulfamoyl group, a carbamoyl group, an alkylthio group, an arylthio group, an alkylsulfonyl group, an arylsulfonyl group, an alkylsulfinyl group, an arylsulfinyl group, a hydroxy group, a halogen atom, a cyano group, a sulfo group, a carboxyl group, a phosphono group, an aryloxycarbonyl group, an acyl group, an alkoxycarbonyl group, an acyloxy group, a carbonamido group, a sulfonamido group, a nitro group, a hydroxamic acid group, and further substituted groups thereof with at least one of these groups.

8. The method for processing a color photographic material as claimed in claim 1, wherein said compound represented by general formula (I) is a compound represented by general formula (II).

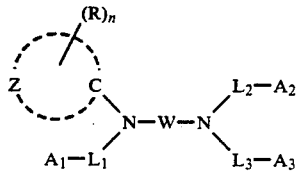

(II)

wherein Z, R, n, and W are as defined in general formula (I); $L_1$, $L_2$ and $L_3$ each represents an alkylene group or an arylene group; and $A_1$, $A_2$ and $A_3$ each represents a carboxyl group.

9. The method for processing a color photographic material as claimed in claim 8, wherein R, is substituted at the carbon atom adjacent to the carbon atom to which the nitrogen atom in the amino group in the formula is connected.

10. The method for processing a color photographic material as claimed in claim 1, wherein said chelate compound of a metal salt is contained in an amount of from 0.01 to 1 mol per liter of the processing solution.

11. The method for processing a color photographic material as claimed in claim 1, wherein said processing solution is a bleaching solution or a bleach-fixing solution.

12. The method for processing a color photographic material as claimed in claim 6, wherein $W^1$ and $W^2$ each represents a $C_{2-4}$ alkylene group.

13. The method for processing a color photographic material as claimed in claim 6, wherein m is 0.

14. The method for processing a color photographic material as claimed in claim 1, wherein R represents a sulfo group, a carboxyl group, or a phosphono group.

15. The method for processing a color photographic material as claimed in claim 1, wherein R represents a carboxyl group.

16. The method for processing a color photographic material as claimed in claim 8, wherein $L_1$, $L_2$ and $L_3$ each represents a methylene group or an ethylene group.

17. The method for processing a color photographic material as claimed in claim 1, wherein $Q_1$, $Q_2$ and $Q_3$ each represents a hydrogen atom, an aliphatic hydrocarbon group substituted by a carboxyl group or a heterocyclic group substituted by a carboxyl group.

* * * * *